US012408734B2

(12) United States Patent
Siegismund et al.

(10) Patent No.: US 12,408,734 B2
(45) Date of Patent: Sep. 9, 2025

(54) ARTICLE OF FOOTWEAR HAVING A CLOSURE SYSTEM

(71) Applicant: PUMA SE, Herzogenaurach (DE)

(72) Inventors: Andreas Siegismund, Rueckersdorf (DE); Reinhold Sussmann, Scheinfeld (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 100 days.

(21) Appl. No.: 18/092,584

(22) Filed: Jan. 3, 2023

(65) Prior Publication Data

US 2023/0210219 A1 Jul. 6, 2023

Related U.S. Application Data

(60) Provisional application No. 63/418,686, filed on Oct. 24, 2022, provisional application No. 63/295,984, filed on Jan. 3, 2022.

(51) Int. Cl.

| | |
|---|---|
| ***A43C 7/04*** | (2006.01) |
| ***A43C 11/16*** | (2006.01) |
| ***A43C 11/20*** | (2006.01) |

(52) U.S. Cl.

CPC ..... *A43C 11/165* (2013.01); *A43C 7/04* (2013.01); *A43C 11/20* (2013.01)

(58) Field of Classification Search

CPC .. A43C 7/00; A43C 7/005; A43C 7/04; A43C 11/165; A43C 11/20

See application file for complete search history.

(56) References Cited

U.S. PATENT DOCUMENTS

| | | | | |
|---|---|---|---|---|
| 3,430,303 | A * | 3/1969 | Wakefield | A43C 11/165 24/712.9 |
| 3,683,520 | A * | 8/1972 | Partagas | A43C 7/04 24/298 |
| 9,578,926 | B2 * | 2/2017 | Alt | A43C 11/165 |
| 10,575,592 | B1 * | 3/2020 | Jones | F16G 11/12 |
| 2009/0205221 | A1 * | 8/2009 | Mitchell | A43C 7/04 24/712.1 |
| 2014/0290014 | A1 * | 10/2014 | Myrick | A43C 11/165 24/712.2 |
| 2017/0265573 | A1 * | 9/2017 | Beers | A43C 11/14 |
| 2018/0153263 | A1 * | 6/2018 | Beers | A43C 1/003 |

* cited by examiner

*Primary Examiner* — Sharon M Prange
(74) *Attorney, Agent, or Firm* — Quarles & Brady LLP

(57) ABSTRACT

A closure system for an article of footwear includes a closure mechanism, a securing element, and a cord or a lace that is configured to be operably engaged with an upper of the footwear. The closure mechanism is configured to be actuated to adjust the footwear from a loosened configuration to a tightened configuration, and the securing element is configured to be engaged with the closure mechanism to removably secure the closure mechanism to the footwear.

7 Claims, 30 Drawing Sheets

ARTICLE OF FOOTWEAR HAVING A CLOSURE SYSTEM

CROSS REFERENCE TO RELATED APPLICATIONS

This application claims the benefit of and priority to U.S. Provisional Application No. 63/418,686, filed on Oct. 24, 2022, and U.S. Provisional Application No. 63/295,984, filed on Jan. 3, 2022, which are incorporated by reference herein in their entireties.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a fastening system or closure system.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms.

SUMMARY

An article of footwear, as described herein, may have various configurations. The article of footwear may have an upper and a sole structure connected to the upper.

In one aspect, a closure system for an article of footwear includes a closure mechanism, a securing element, and a lace that is configured to be operably engaged with an upper of the footwear. The securing element is configured to be engaged with the footwear and the closure mechanism to removably secure the closure mechanism to the footwear. The closure mechanism is configured to be rotated relative to the securing element to adjust the footwear between a loosened configuration and a tightened configuration. The lace is configured to be engaged with the closure mechanism.

In some embodiments, the closure mechanism includes a collector spool that has at least one mounting tip protruding therefrom and a spool housing includes a notch that is configured to receive the at least one mounting tip. In some embodiments, the lace is passed through a plurality of eyelets formed on the upper and through at least one channel formed on the collector spool. In some embodiments, the securing element is attached to a tongue of the footwear. In some embodiments, the securing element further comprises a hook that is configured to be engaged to the tongue of the footwear. In some embodiments, the spool housing defines an interior volume and the collector spool is configured to be entirely contained within the interior volume.

In some aspects, a closure system for an article of footwear includes a closure mechanism, a securing element, and a lace that is configured to be operably engaged with an upper of the footwear. The closure mechanism is configured to be actuated to adjust the footwear from a loosened configuration to a tightened configuration. The closure mechanism includes a first spool and a second spool. The first spool defines a first rotation axis and the second spool defines a second rotation axis that is disposed orthogonally relative to the first rotation axis. The first spool is configured to be removably engaged to the second spool, and the first spool is configured to be rotated about the first rotation axis and the second rotation axis.

In some embodiments, the second spool includes an upper portion, a shaft, and a lower portion. The upper portion is configured to be rotated relative to the lower portion. In some embodiments, the upper portion includes a plurality of projections, and a head cap is removably attached to the plurality of projections. In some embodiments, the first spool includes a shaft that is disposed between a first flange and a second flange, the shaft including at least one aperture to receive the lace. In some embodiments, the securing element includes a hinged mechanism for removably mounting the closure mechanism to the article of footwear. In some embodiments, the first and second flanges are configured to be rotatably engaged with a spool base. In some embodiments, the closure mechanism is removably attached to the securing element. In some embodiments, a lower portion of the closure mechanism includes a hook that is configured to be removably attached to a tongue of an article of footwear. In some embodiments, the securing element is a U-shaped member that defines a channel through which at least a portion of the lace is passed.

In still another aspect, a method of assembling a closure system for an article of footwear includes the step of providing a closure mechanism comprising at least one spool that includes a shaft with at least one tab and an aperture. The method further includes the steps of providing a securing mechanism that is configured to removably secure the closure mechanism to the article of footwear and providing a lace for engagement with the closure mechanism, the lace being coupled to the shaft. The spool is rotated in a first direction to adjust the article of footwear to a tightened configuration and the spool is rotated in a second direction to adjust the article of footwear to loosened configuration.

In some embodiments, the first direction is opposite the second direction. In some embodiments, the securing mechanism is disposed on an upper of the footwear.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
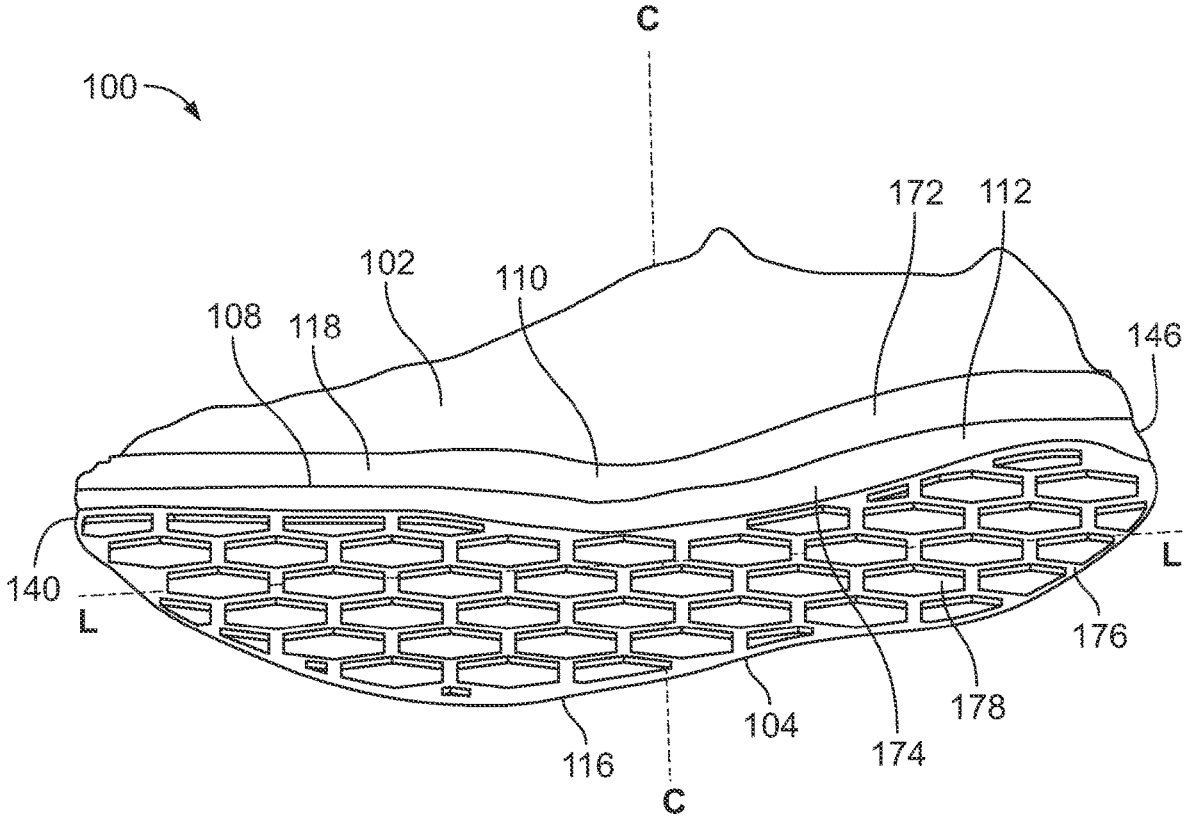
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
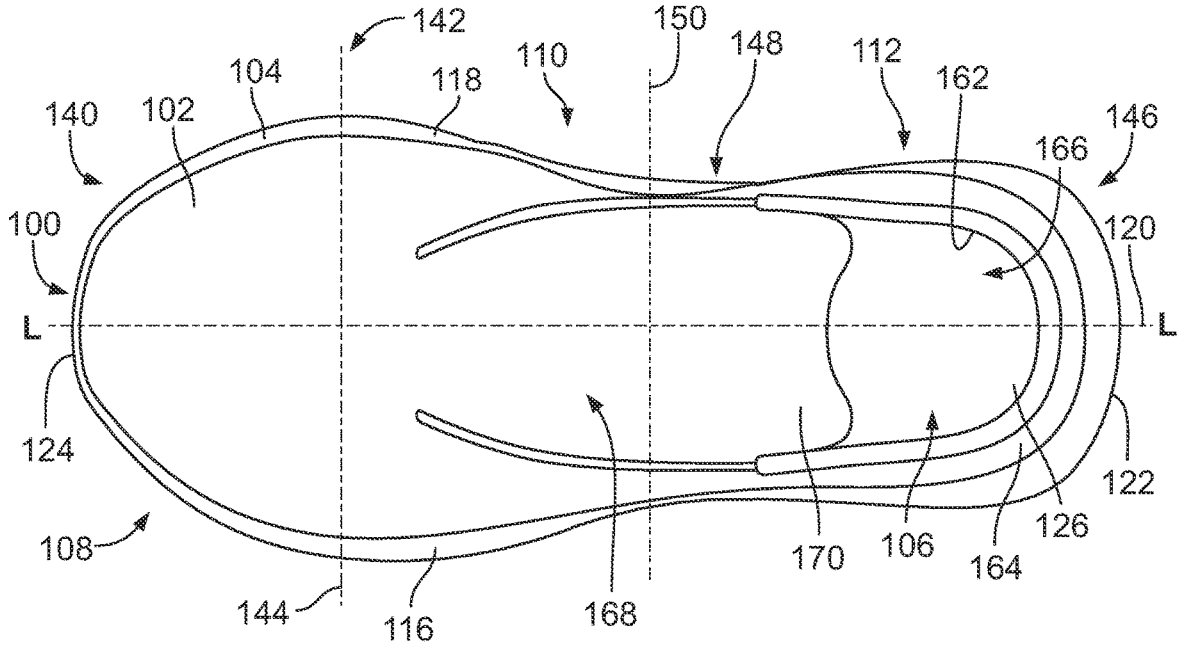
FIG. 2 is a top view of the article of footwear of FIG. 1.
Figure 3:
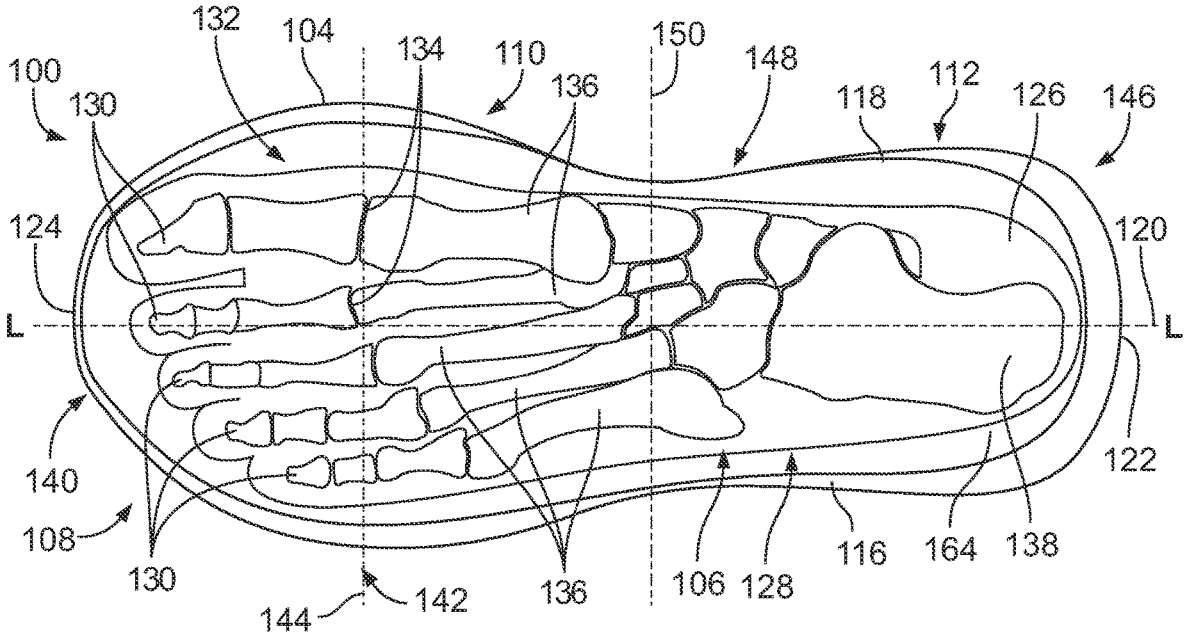
FIG. 3 is a top plan view of the article of footwear of FIG. 1, with an upper removed and a user's skeletal foot structure overlaid thereon.

FIGS. 1-3 depict an exemplary embodiment of an article of footwear 100 including an upper 102 and a sole structure 104. The upper 102 is attached to the sole structure 104 and together define an interior cavity or volume 106 (see FIGS. 2 and 3) into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole structure 104, the insole, or the like, and/or by f moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or central axis 120 of the article of footwear 100, which is coplanar with the longitudinal axis L of FIG. 1. As will be further discussed herein, the longitudinal central plane or central axis 120 may demarcate a central, intermediate axis between the medial side 118 and the lateral side 116 of the article of footwear 100. Put differently, the longitudinal plane or central axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or central axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of a foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the central axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the central axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

In the illustrated embodiment, the sole structure 104 includes a midsole 172 and an outsole 174. The outsole 174 may define a bottom end or bottom surface 176 of the sole structure 104 across the heel region 112, the midfoot region 110, and the forefoot region 108. Further, the outsole 174 may be a ground-engaging portion or include a ground-engaging surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be formed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Figure 4:
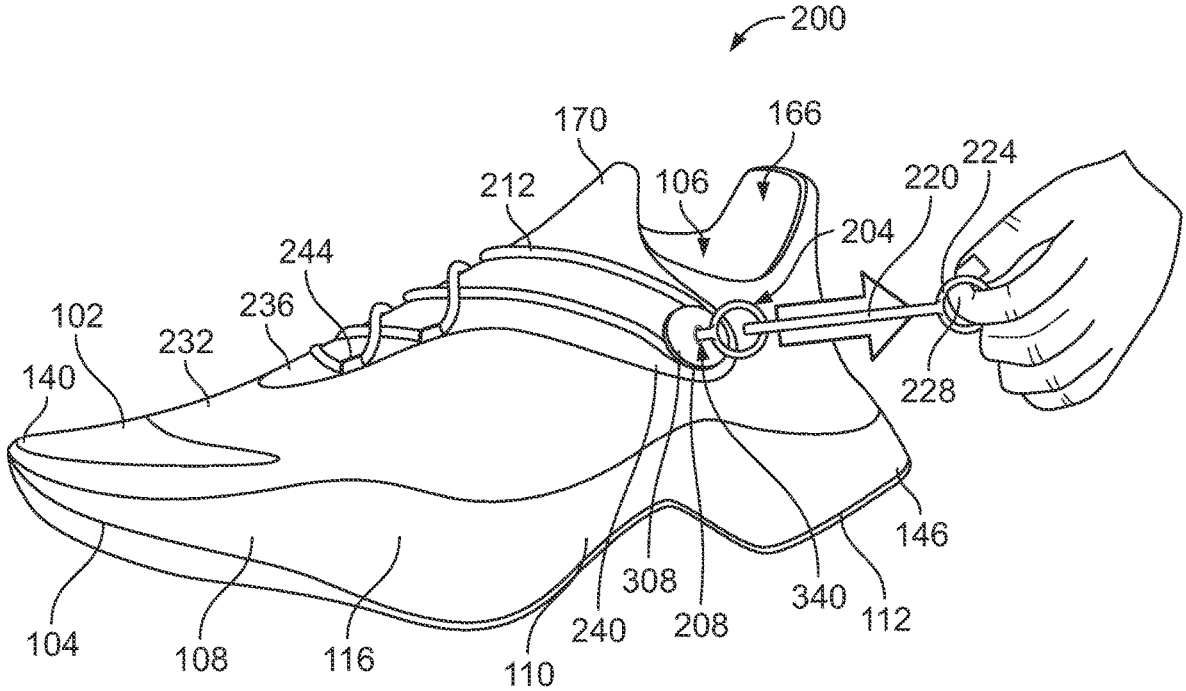
FIG. 4 is a schematic representation of a perspective view of a lateral side of an article of footwear configured as a left shoe, according to another embodiment of the present disclosure.

FIG. 4 depicts a schematic representation of an article of footwear 200 having a closure system 204 that includes a closure mechanism 208 and a cord 212 that is operably coupled to the upper 102 and the closure mechanism 208 to tighten and/or loosen the footwear 200. Further, the closure system 204 includes an actuating mechanism in the form of a cable 220 having a ring end 224 that is configured to be pulled by a user's finger 228 to actuate the closure system 204 to perform one or more functions, such as, e.g., tightening, unlocking, retracting. To that end, the cable 220 is configured to be pulled away from the closure mechanism 208 to actuate one of the functions of the closure system 204, and the cable 220 is configured to be retracted into the closure mechanism 208 to prevent entanglement, as will be described herein.

Referring to FIG. 4, the upper 102 includes a base layer 232 and an overlay 236 superimposed on a portion of the base layer 232. In particular, the overlay 236 is affixed to the base layer 232 within the forefoot region 108 and the midfoot region 110 of the upper 102. Additionally, the overlay 236 includes a wing portion 240 that extends diagonally heel-ward, i.e., toward the heel end 146, and laterally, i.e., toward the lateral side 116, of the footwear 200. The wing portion 240 is an oblong-shaped portion on which the closure mechanism 208 is located. In other embodiments, the closure mechanism 208 is attached elsewhere on the overlay 236, the upper 102, or the sole structure 104. As illustrated in FIG. 4, the cord 212 is laced in an overlapping pattern along the overlay 236 and through eyelets or guides 244 located on the upper 102. Accordingly, the guides 244 define the overlapping pattern that distributes the compression force applied by the closure system 204 for tightening the footwear 200. In the illustrated embodiments, the guides 244 are located on the overlay 236, although other configurations are possible. In some instances, the guides 244 may be formed by the overlay 236 or affixed to the upper 102 by the overlay 236. In other embodiments, the guides 244 are provided on the base layer 232 of the upper 102 and separately from the overlay 236.

Figure 5:
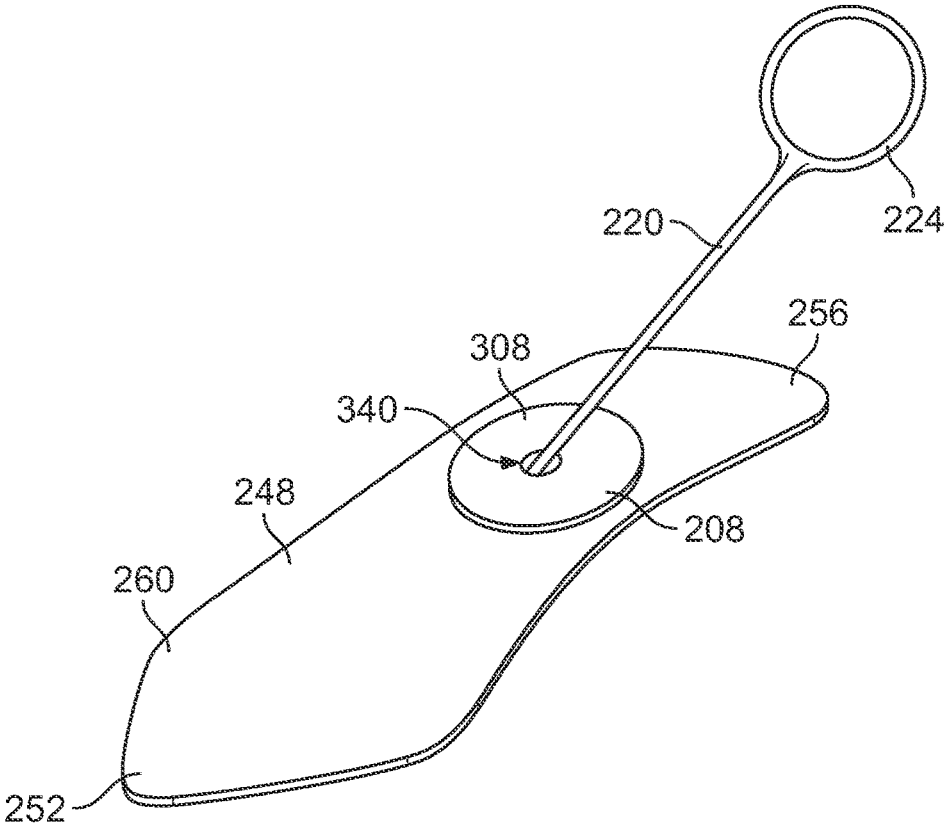
FIG. 5 is a schematic representation of a perspective view of a top side of a securing element.

FIG. 5 depicts the closure mechanism 208 arranged on a securing element in the form of a panel 248 that is configured to be removably attached to the footwear 200. In the illustrated embodiment, the panel 248 includes a first end or front 252 opposite a second end or rear 256, and a top side 260 opposite a bottom side (not shown). In the illustrated embodiment, the closure mechanism 208 is positioned closer to the rear 256 than to the front 252 of the panel 248, although other positions are contemplated. The panel 248 is configured to be removably attached to the upper 102 to secure the closure mechanism 208 to the upper 102 and to conceal or hide portions of the closure mechanism 208 from exposure externally of the footwear 200. To that end, the panel 248 may be fastened between layers of the upper 102, such as between the overlay 236 and the base layer 232, such that the panel 248 and the closure mechanism 208 are concealed or hidden beneath the overlay 236. Further, the panel 248 can be fastened in various fashions, such as, e.g., frictional and/or compression forces exerted between the overlay 236 and the base layer 232 of the upper 102 when the closure system 204 is actuated to tighten the footwear 200. In this way, the panel 248 is securely tightened to the upper 102 while the footwear 200 is tightened, and then the panel 248 is loosened for removal from the upper 102 when the footwear 200 is loosened. Additionally or alternatively, the panel 248 is attached by an adhesive, a twist-lock, by interaction with the cord 212, by engagement with a fastener, or by insertion into a pocket (not shown) formed between or among the layers of the upper 102, among other configurations.

Referring to FIGS. 4 and 5, the wing portion 240 of the overlay 236 can be partially affixed to the base layer 232 of the upper 102, so as to be slipped between the base layer 232 and the overlay 236 with the rear 256 positioned beneath the wing portion 240 on the lateral side 116 of the footwear 200 and the front 252 of the panel 248 positioned closer to the medial side 118 of the footwear 200. In this way, the rear 256 of the panel 248 is suitably shaped to cooperate with the shape of the wing portion 240 and secured by the compression and/or friction forces applied when the footwear 200 is tightened by the closure system 204. It is also contemplated that a mounting recess (not shown) is formed on the base layer 232 to receive a portion of the closure mechanism 208, which also assists in removably securing the closure mechanism 208 and the panel 248 to the upper 102. Accordingly, the closure mechanism 208 is removably mounted to the upper 102 on the lateral side 116 of the footwear 200.

It is further contemplated that the closure mechanism 208 may be removably mounted to the upper 102 and without the panel 248. In some embodiments, the closure mechanism 208 is secured to the upper 102 by a portion of the cord 212, such that the cord 212 can be looped through the closure mechanism 208 and tightened to the upper 102 during operation of the closure system 204 to tighten the footwear 200. In other embodiments, the closure mechanism 208 is fastened in another fashion to the upper 102 or the sole structure 104, such as, e.g., using adhesive, hook-and-loop fasteners, zippers, snap-fit fasteners, twist-lock fasteners, and the like. Accordingly, the closure mechanism 208 is configured to be removably mounted to the footwear 200 for operation with the cord 212 to tighten and/or loosen the footwear 200. In this way, the closure mechanism 208 is configured to be used with multiple articles of footwear, such as when a user changes shoe size or styles, and especially footwear for children at ages when shoe size changes frequently. Further, removal of the closure mechanism 208 allows the user to instead wear the footwear 200 with conventional lacing fasteners or in a loosened slip-on fashion. It is further contemplated that the closure mechanism 208 may be attached to articles of clothing, sports equipment, and luggage or storage items for tightening and/or loosening, among other uses.

Figure 6:
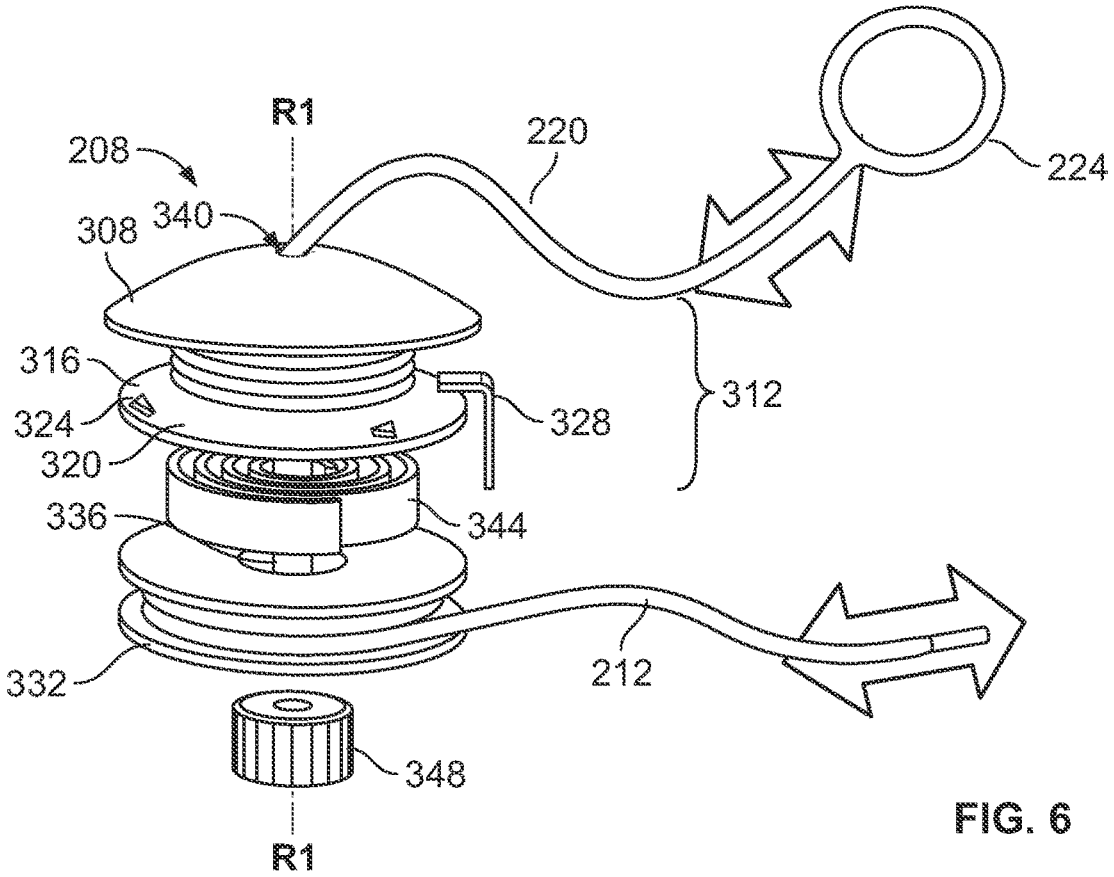
FIG. 6 is a schematic representation of an exploded view of an embodiment of a closure mechanism.

FIG. 6 is a schematic representation of an exploded view of the closure mechanism 208. In the illustrated embodiment, the closure mechanism 208 includes a head cap 308 that is attached to a rotary ratchet 312 that includes a first spool 316 around which a portion of the cable 220 is configured to be collected or wound. The rotary ratchet 312 further comprises a flange 320 having a plurality of projections 324 spaced radially and configured for engagement with an arm 328. In the illustrated embodiment, the head cap 308 and the rotary ratchet 312 are attached to a second spool 332 by a shaft 336 that defines a rotational axis R1. Further, the cable 220 is threaded through an aperture 340 formed in the head cap 308 so that when the cable 220 is pulled through the aperture 340, the rotary ratchet 312 rotates about the rotational axis R1. Accordingly, the first spool 316 functions as a collector for the cable 220 and the second spool 332 functions as a collector for the cord 212.

Additionally, a biasing mechanism 344 is provided in the form of a coil spring for engagement with the rotary ratchet 312 to retrieve or collect the cable 220 after being withdrawn or pulled out from the closure mechanism 208. Further, a slip clutch 348 is fitted onto the shaft 336 for selective engagement with the second spool 332 and the rotary ratchet 312. For example, when the slip clutch 348 is engaged with the rotary ratchet 312 and the second spool 332, rotation of the shaft 336 is transmitted by the slip clutch 348 to the second spool 332 for collecting or winding the cord 212 about the second spool 332. Then, when a release function of the closure mechanism 208 is actuated, the slip clutch 348 is disengaged with the rotary ratchet 312 or the second spool 332 to allow the cord 212 to be withdrawn or unwound from the second spool 332. It is further contemplated that the cable 220 can be pulled in different directions to actuate different functions, such that a particular function is associated with a particular direction.

Figure 7:
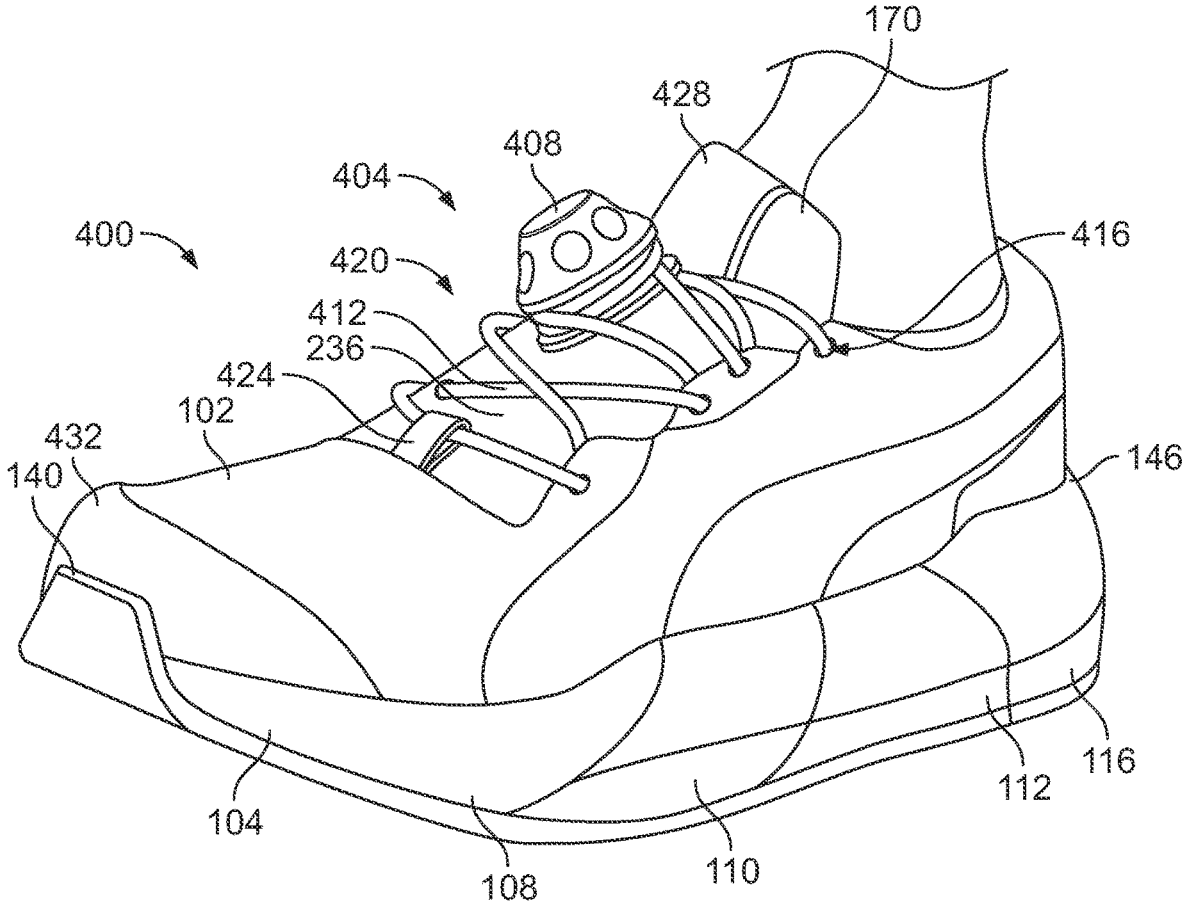
FIG. 7 is a schematic representation of a perspective view of a lateral side of an article of footwear configured as a left shoe, according to another embodiment of the present disclosure.

FIG. 7 illustrates a schematic representation of another embodiment of an article of footwear 400 having a closure system 404. In the illustrated embodiment, the closure system 404 includes a closure mechanism 408 that is operably attached to a lace 412. The lace 412 is operably engaged with a plurality of eyelets 416 to define a winding region 420 of the upper 102. In particular, the closure mechanism 408 is configured to be removably mounted to the upper 102 for adjusting the footwear 400 between tightened and loosened configurations. The lace 412 is passed through the eyelets 416 disposed on the upper 102 in the winding region 420 and also through a flap 424 that is attached to an overlay 236 on the upper 102. The upper 102 also includes a pull tab 428 that is attached to the tongue 170 of the footwear 400 for allowing a user to pull or reposition the tongue 170 when tightening and loosening the footwear 400. As illustrated in FIG. 7, the closure mechanism 408 is located within the winding region 420 and entirely exposed externally of the footwear 400 while being secured against the tongue 170. In the illustrated embodiment, a bumper 432 is provided at the toe end 140 of the upper 102. The bumper 432 may be provided as a thickened band of elastomeric material that extends across the toe end 140 of the upper 102 to insulate a user's toes inside the upper 102, although other configurations are possible.

Figure 8:
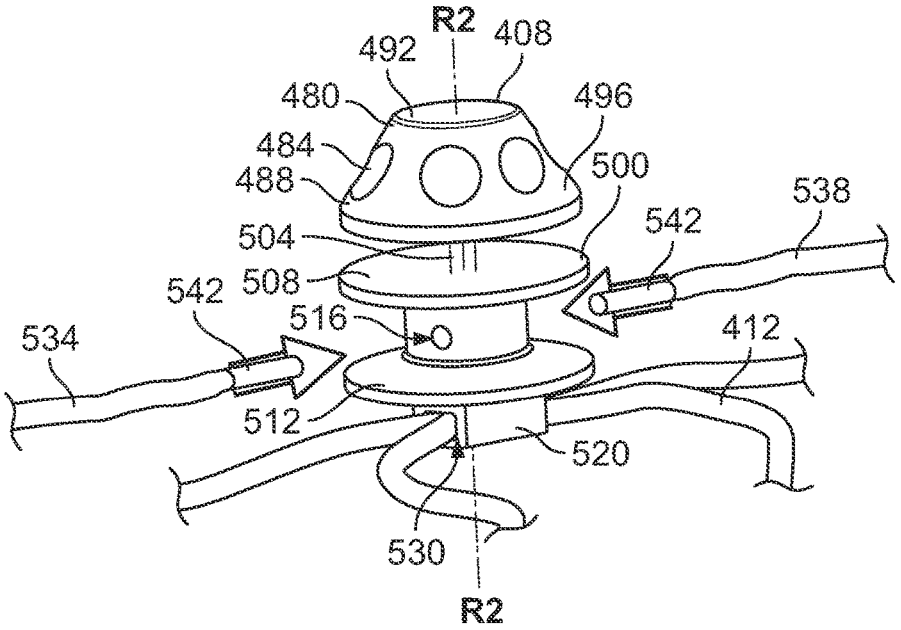
FIG. 8 is a schematic representation of an exploded view of another embodiment of a closure mechanism.

FIG. 8 is a schematic representation of an exploded view of the closure mechanism 408 that is configured to be removably mounted to the upper 102. In the illustrated embodiment, a head cap 480 is shaped to be frustoconical, i.e., a truncated cone, with indentations 484 formed on an angled sidewall 488 between a top end 492 and a lower end 496. The indentations 484 and frustoconical shape of the head cap 480 allow for ergonomic engagement by a user when rotated to actuate the closure system 404. In addition, the head cap 480 is attached to a collector spool 500 by a shaft 504 that defines a rotational axis R2 of the closure mechanism 408. In the illustrated embodiment, the collector spool 500 includes an upper flange 508, a lower flange 512, and a passage 516 that extends transversely relative to the rotational axis R2 through the collector spool 500. The upper and lower flanges 508, 512 are cylindrical, although other shapes are possible.

Additionally, a securing element 520 is attached to the lower flange 512 of the collector spool 500 for securing the closure mechanism 408 to the footwear 400. In some embodiments, the securing element 520 is included as part of the closure mechanism 408. Further, a locking interface (not shown), e.g., a plurality of intermeshed teeth, may be provided between the collector spool 500 and the securing element 520 to incrementally secure the collector spool 500 against rotation relative to the securing element 520 in a particular direction. In this particular embodiment, the securing element 520 includes a channel 530 that extends transversely relative to the rotational axis R2. The collector spool 500 can be fixedly attached to the head cap 480 to allow for simultaneous rotation therewith about the rotational axis R2. Further, the collector spool 500 may be rotatably attached to the securing element 520, such that the securing element 520 remains fixed against rotation about the rotational axis R2 when engaged with the lace 412. As illustrated in FIG. 8, the lace 412 includes opposing first and second ends 534, 538 each having an aglet 542 thereon, although other configurations are possible.

It is contemplated that the closure mechanism 408 can be attached to any footwear having a conventional lace similar to the footwear 400 of FIG. 7. For example, a user can pass the lace 412 through the flap 424 and less than all of the plurality of eyelets 416, such that at least two of the eyelets 416 remain open and disengaged with the lace 412. In some embodiments, four of the eyelets 416 and, preferably, the four of the eyelets 416 disposed closest to the pull tab 428 of the tongue 170 in the midfoot region 110, remain disengaged with the lace 412 before attaching the closure mechanism 408 to the footwear 400, such that the first and second ends 534, 538 of the lace 412 are free and the footwear 400 is in a loosened configuration. With reference to FIG. 8, the user passes portions of the opposing first and second ends 534, 538 of the lace 412 through the channel 530 of the securing element 520 in opposing directions, transversely to the rotational axis R2. In this way, the closure mechanism 408 is removably coupled to the lace 412 and, thus, to the footwear 400.

As illustrated in FIG. 7, the closure mechanism 408 is positioned in the midfoot region 110 and between the flap 424 and the pull tab 428, although other locations are contemplated.

Next, the user can pass the first and second ends 534, 538 of the lace through the remaining eyelets 416, or, alternatively, the user can pass the lace 412 through less then all of the eyelets 416. Subsequently, the user passes the first and second ends 534, 538 of the lace 412 through the passage 516 in the collector spool 500 in opposing directions, transversely to the rotational axis R2, as illustrated in FIG. 8. In some instances, the passage 516 has a smaller diameter than the channel 530, such that when the lace 412 is received within the passage 516, an increased frictional force prevents the lace from slipping out of the passage 516 and relative to one another. In this way, the closure mechanism 408 is configured to further secure the lace 412 against loosening when the footwear 400 is in the tightened configuration. It is contemplated that the passage 516 and the channel 530 may define identical diameters, or the passage 516 may define a larger diameter than the channel 530. Next, the user can pull the first and second ends 534, 538 of the lace 412 away from the collector spool 500 to tightly fasten the lace 412 and the closure mechanism 408 to the footwear 400. In some embodiments, the user can tie a knot of any suitable kind to secure the first and second ends 534, 538, of the lace 412 relative to the closure mechanism 408, although this is not necessary.

Finally, the user actuates the closure mechanism 408 by rotating that head cap 480 of the closure mechanism 408 about the rotational axis R2 to wind the lace 412 about the collector spool 500. In this way, as the first and second ends 534, 538 of the lace 412 become wound about or collected by the collector spool 500 by rotation thereof, the footwear 400 is adjusted from the loosened configuration to a tightened configuration. Further, during rotation of the head cap 480 and the collector spool 500, the securing element 520 is stationary about the rotational axis R2 due to the engagement with the lace 412, and the locking interface (not shown) between the collector spool 500 and securing element 520 prevents reverse rotation of the collector spool 500 about the rotational axis R2 and relative to the securing element 520. In this way, the closure mechanism 408 can be operated to provide incremental adjustment of the footwear 400 into the tightened configuration via engagement with the lace 412 of the footwear 400.

To adjust the footwear 400 from the tightened configuration to the loosened configuration, the user may pull the head cap 480 away from the collector spool 500 to create a spacing in which the collector spool 500 may translate axially, i.e., parallel with the rotational axis R2, away from the locking interface (not shown) on the securing element 520. Accordingly, the collector spool 500 can freely rotate in the reverse direction about the rotational axis R2 and relative to the securing element 520, such that the lace 412 may be unwound from the collector spool 500. In some embodiments, the user can untie any knot that was formed to fasten the lace 412 to the collector spool 500, and the user can locate the first and second ends 534, 538 to unwind the lace 412 from the collector spool 500. Further, the lace 412 is removed from the channel 530 of the securing element 520 to completely detach the closure mechanism 408 from the footwear 400.

Figure 9:
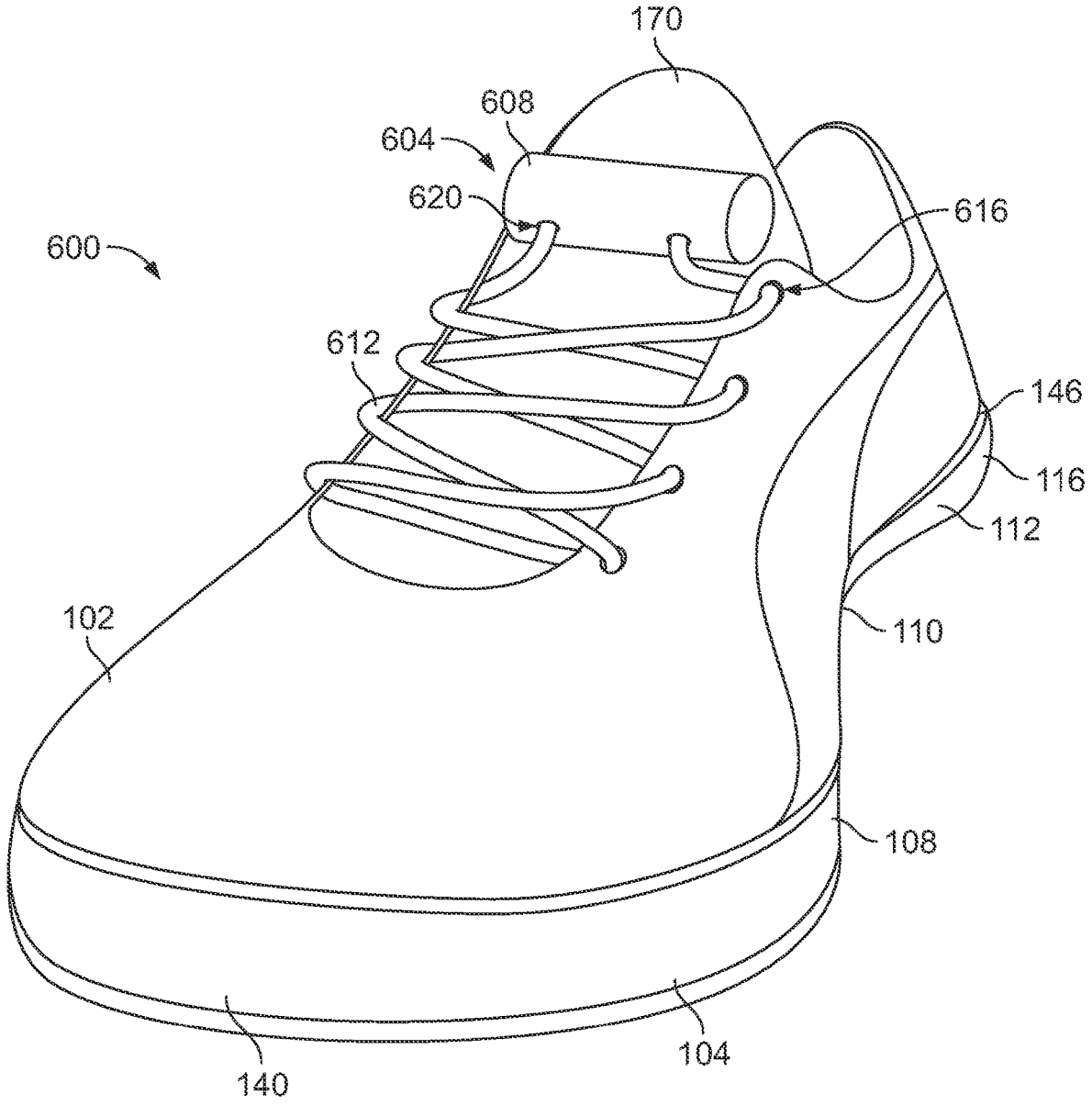
FIG. 9 is a schematic representation of a perspective view of a lateral side of an article of footwear configured as a left shoe and having a closure system, according to yet another embodiment of the present disclosure.

FIG. 9 depicts a schematic representation of another embodiment of an article of footwear 600 having a closure system 604 that includes a closure mechanism 608 and a lace 612 that is operably coupled to the upper 102 and the closure mechanism 608 to tighten and/or loosen the footwear 600. In this embodiment, elements that are shared with—i.e., that are structurally and/or functionally identical or similar to—elements present in the first embodiment (article of footwear 100) are represented by like reference numerals. The lace 612 is operably engaged with a plurality of eyelets 616 to define a winding region 620 of the upper 102. In particular, the closure mechanism 608 is configured to be removably mounted to the upper 102 for adjusting the footwear 600 between tightened and loosened configurations. The lace 612 is passed through the eyelets 616 disposed on the upper 102 in the winding region 620. The eyelets 616 may be provided as openings or holes in the upper 102 alongside/adjacent the tongue 170, and the laces 612 may be passed therethrough. Additionally or alternatively, the eyelets 616 may be provided as loops, flaps, or hooks extending from the upper and disposed along or on the tongue 170 for engagement with the laces 612. As illustrated in FIG. 9, the closure mechanism 608 is located within the winding region 620 and entirely exposed externally of the footwear 600 while being secured against the tongue 170. In the illustrated embodiment, the closure mechanism 608 is configured to be removably mounted to the upper 102 for adjusting the footwear 600 between tightened and/or loosened configurations.

Figure 10:
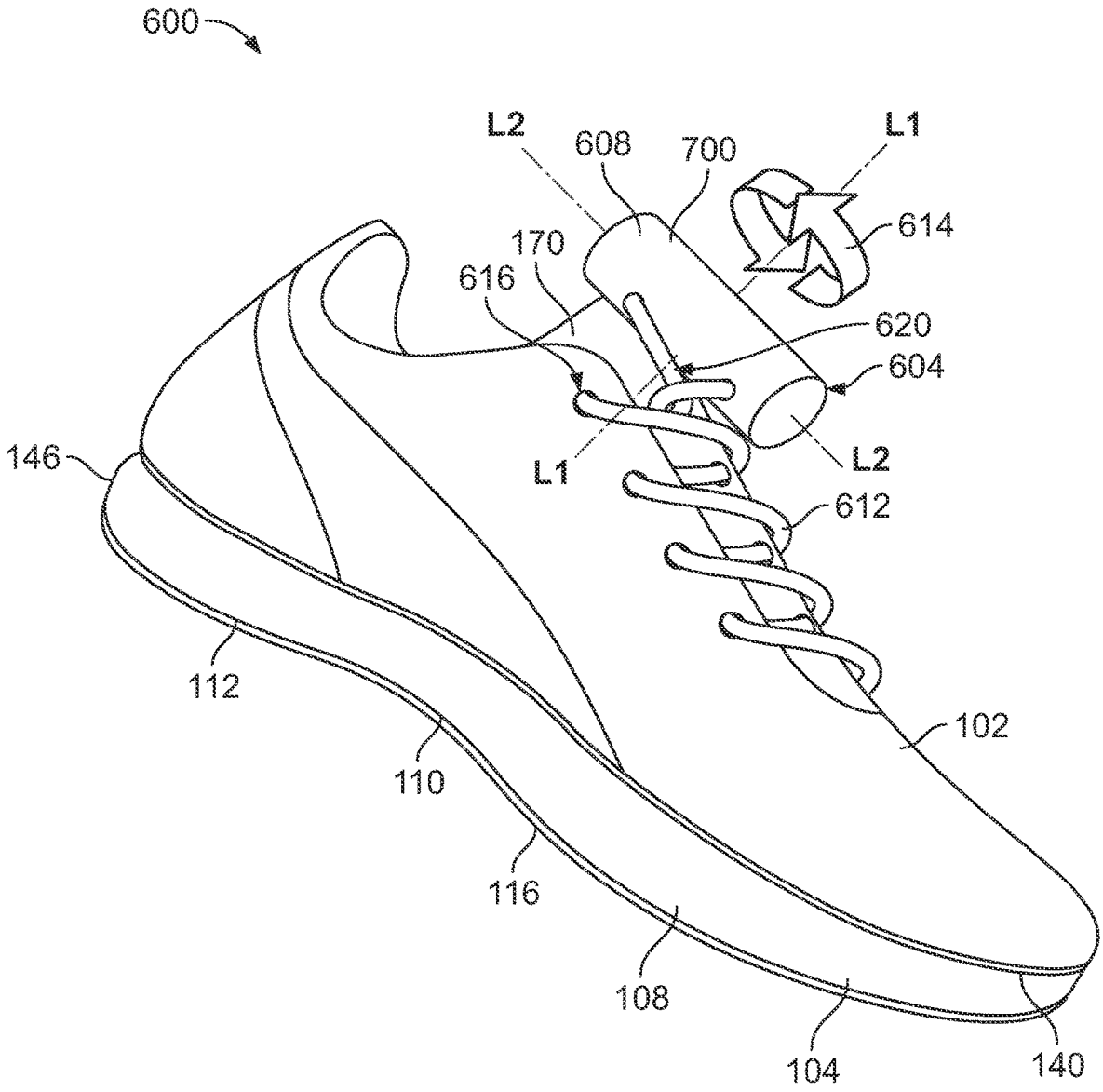
FIG. 10 is a perspective view of a shoe upper with a closure system.

FIG. 10 is a perspective view of the upper 102 with the closure system 604. The closure mechanism 608 includes a collector spool 700 (See FIG. 11) about which a portion of the lace 612 is configured to be wound or wrapped. Illustrative arrows 614 are provided to indicate the tightening and loosening of the laces 612 about a lateral axis L1. The closure system 604 is configured to be rotated to adjust the footwear 600 from a loosened configuration to a tightened configuration and/or from a tightened configuration to a loosened configuration. In some embodiments, the closure mechanism 608 may be rotated about a longitudinal axis L2 that is define along an elongate direction of the closure mechanism 608.

Figure 11:
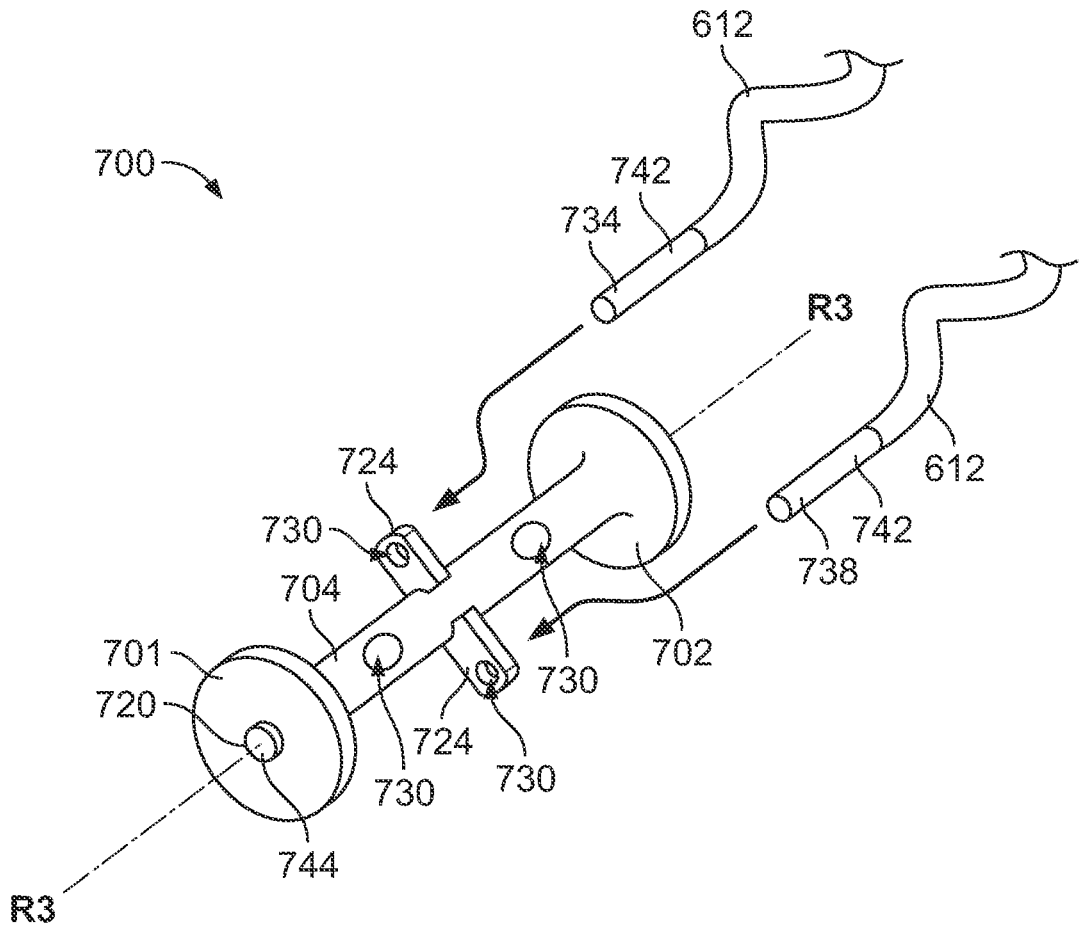
FIG. 11 is a pre-assembly state or configuration of an embodiment of a closure mechanism.

FIG. 11 is a schematic representation of a pre-assembly state or configuration, with illustrative arrows provided to indicate an insertion path along which the lace 612 is configured to be engaged with the collector spool 700. In the illustrated embodiment, the collector spool 700 includes a shaft 704 extending linearly between the disc-shaped flanges 701, 702 to define a spool rotational axis R3, and a pair of tabs 724 positioned centrally on the shaft 704 between the disc-shaped flanges 701, 702. Each tab 724 defines a channel 730 through which a portion of the lace 612 is passed for engagement with the collector spool 700. In some embodiments, a portion of the lace 612 and/or one end of the lace 612 is affixed within the channel 730. It is contemplated that the user can untie any knot that was formed to fasten the lace 612 to the collector spool 700, and then the user can locate the first and second ends 734, 738 of the lace 612 to unwind the lace 612 from the collector spool 700. In some embodiments, an aglet 742 of the lace 612 may include a lace lock (not shown) to affix the lace 612 with the collector spool 700 and prevent the lace 612 from being removed from the channel 730. The first and second disc-shaped flanges 701, 702 each include a mounting tip 744 extending axially therefrom and intersected by the rotational axis R3. In some embodiments, the first and second disc-shape flanges 701, 702 may be formed integrally with the shaft 704. In operation, the laces 612 are threaded through the channels 730 of the tabs 724 and wound around the shaft 704, which may be performed during manufacturing to provide the article of footwear 600 with pre-wound laces 612 to be adjusted by the user upon initial use. Alternatively, the footwear 600 may be provided with laces 612 that are only partially installed and require the user to complete assembly of the closure system 604 by attaching the laces 612 to the collector spool 700 prior to use. It will be appreciated that the laces 612 of the closure system 604 are configured to be accessible and removable at any time, as desired by the user or necessitated by degradation of the laces 612 during use. In some embodiments, the channels 730 may be formed transversely through the shaft 704, as illustrated in FIG. 11. In this way, the channels 730 are configured to receive the laces 612 and allow the laces 612 to be wound about the shaft 704. In some embodiments, the first and the second disc-shaped flanges 701, 702 may be rotatably attached to opposing ends of the shaft 704 to provide rotatable joint connections with the shaft 704, such that the shaft 704 is capable of rotating about the spool rotational axis R3 relative to the first and second disc-shaped flanges 701, 702, which may be fixed in place and prevented from rotation.

Figure 12:
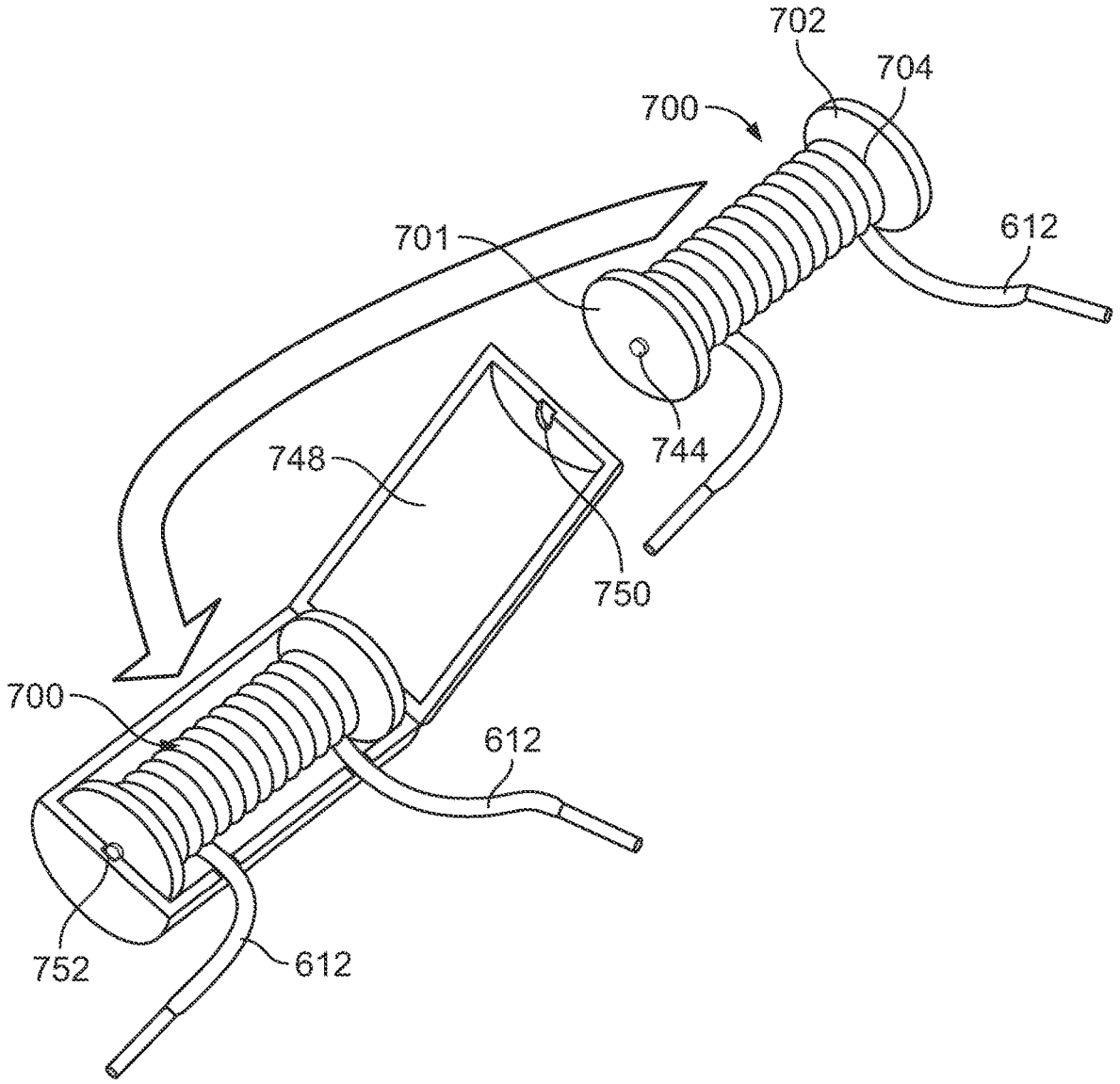
FIG. 12 is a pre-assembly state or configuration of an embodiment of a closure mechanism and an assembled state or configuration of one embodiment of a closure mechanism.

In operation, the collector spool 700 is contained inside of a housing 748, as illustrated in FIG. 12. In the illustrated embodiment, the mounting tips 744 are received within axial notches 750 formed inside of the housing 748. In this way, the collector spool 700 is configured to receive the laces 612, which can be wound around the shaft 704 of the collector spool 700 upon rotation of the collector spool 700 within the housing 748. Further, the collector spool 700 is configured to be rotated within the housing 748 about the mounting tips 744 received in the axial notches 750, such that the collector spool 700 freely rotates within an interior cavity of the housing 748. As the shaft 704 retrieves the laces 612, an operative diameter of the laces 612 wound on the shaft 704 increases. When tightening the closure system 604, there is an increase in the operative diameter of the laces 612 as greater lengths of the laces 612 are wound around the collector spool 700. In some embodiments the axial notches 750 may be disposed about first and second disc-shaped flanges 701, 702 and the mounting tips 744 may be disposed at the opposing ends of the housing 748 with respect to the spool rotational axis R3. A pivot joint 752 is formed by the mounting tips 744 and the axial notches 750, which enables rotational motion of the collector spool 700 within the housing 748. In some embodiments, the mounting tips 744 or the axial notches 750, or some combination thereof, may be provided with surface texture, ridges, nubs, teeth, gearing, or the like to increase friction forces acting against rotation of the collector spool 700 in the housing 748, such that the collector spool 700 is configured to resist unwinding and maintain incremental changes in tension applied to the lace 612.

Figure 13:
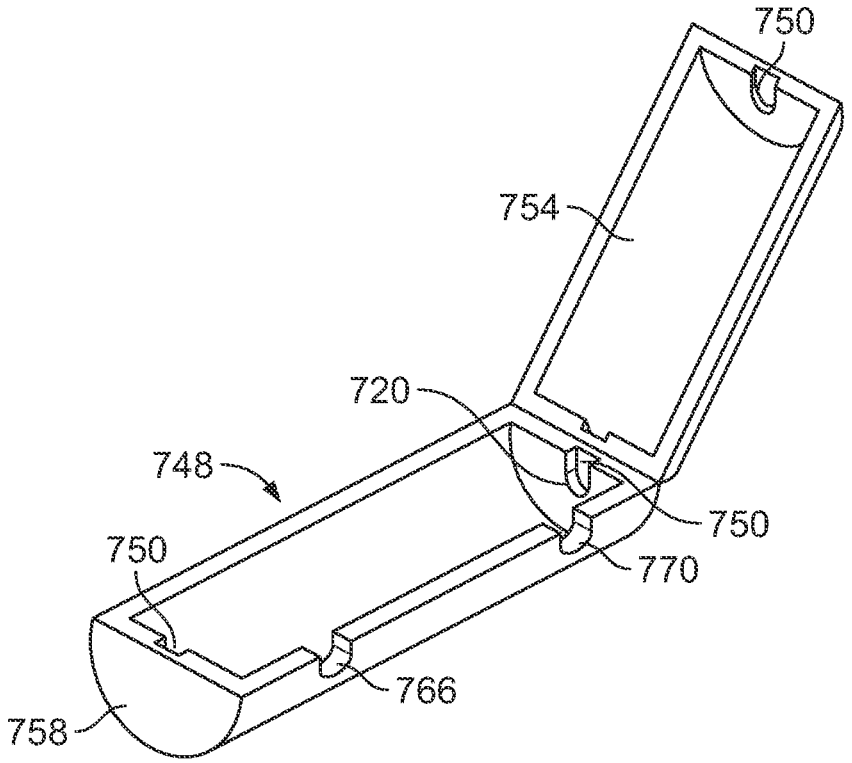
FIG. 13 is a schematic representation of one embodiment of a closure mechanism.

FIG. 13 is a schematic representation of the housing 748 of the closure mechanism 608. The housing 748 has a first part 754 and a second part 758 on which the axial notches 750 are formed for receiving the mounting tips 744 of the collector spool 700. Further, a locking interface (not shown), may be provided between the collector spool 700 and the securing element 720 to incrementally secure the collector spool 700 against rotation relative to the securing element 720 in a particular direction. The mounting tip 744 and/or the axial notches 750 may function as the securing element to inhibit or selectively allow rotation. The housing 748 may include a first channel 766 and a second channel 770 disposed partially by the first part 754 and the second part 758 of the housing 748. It is within the scope of this disclosure that mechanisms and elements disclosed in connection with the embodiments of FIGS. 7 and 8 may also be implemented with the closure system 604.

Figure 14:
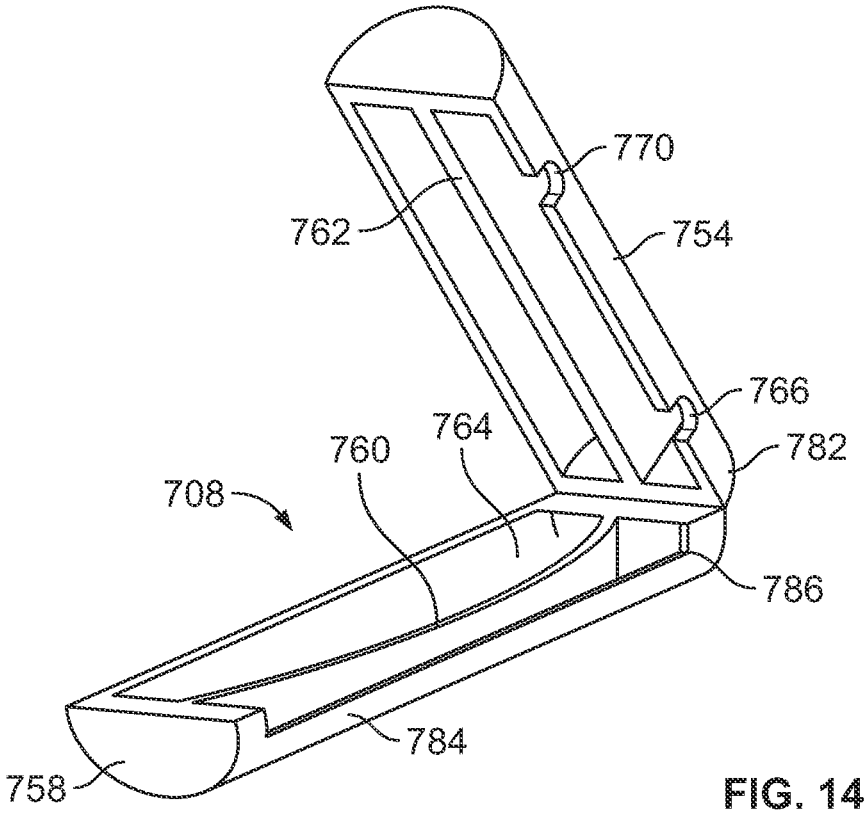
FIG. 14 is a schematic representation of an alternate embodiment of a closure mechanism.

FIG. 14 is a schematic representation of another embodiment of a housing 780 of a closure mechanism 608 (see FIG. 10), which shares similarities to the housing 748 of FIG. 13. In the illustrated embodiment, the housing 780 comprises the first part 754 and the second part 758. The housing 780 may include the shaft 760 comprising a first shaft part 762 that is formed adjacent to the first part 754 of the housing 780 and a second shaft part 764 that is formed adjacent to the second part 758 of the housing 780. The first channel 766 and the second channel 770 are disposed within an upper side wall 782 of the first part 754 of the housing 780. The second part 758 includes a lower sidewall 784 that includes a cutout 786. The housings 748, 780 are illustrated in FIGS. 12-14 as generally cylindrical-shaped housings. In some embodiments, the housings 748, 780 may be provided in triangular prism shapes, cuboid shapes, polygonal shapes, rectangular shapes, irregular shapes, or any suitable shapes.

Figure 15:
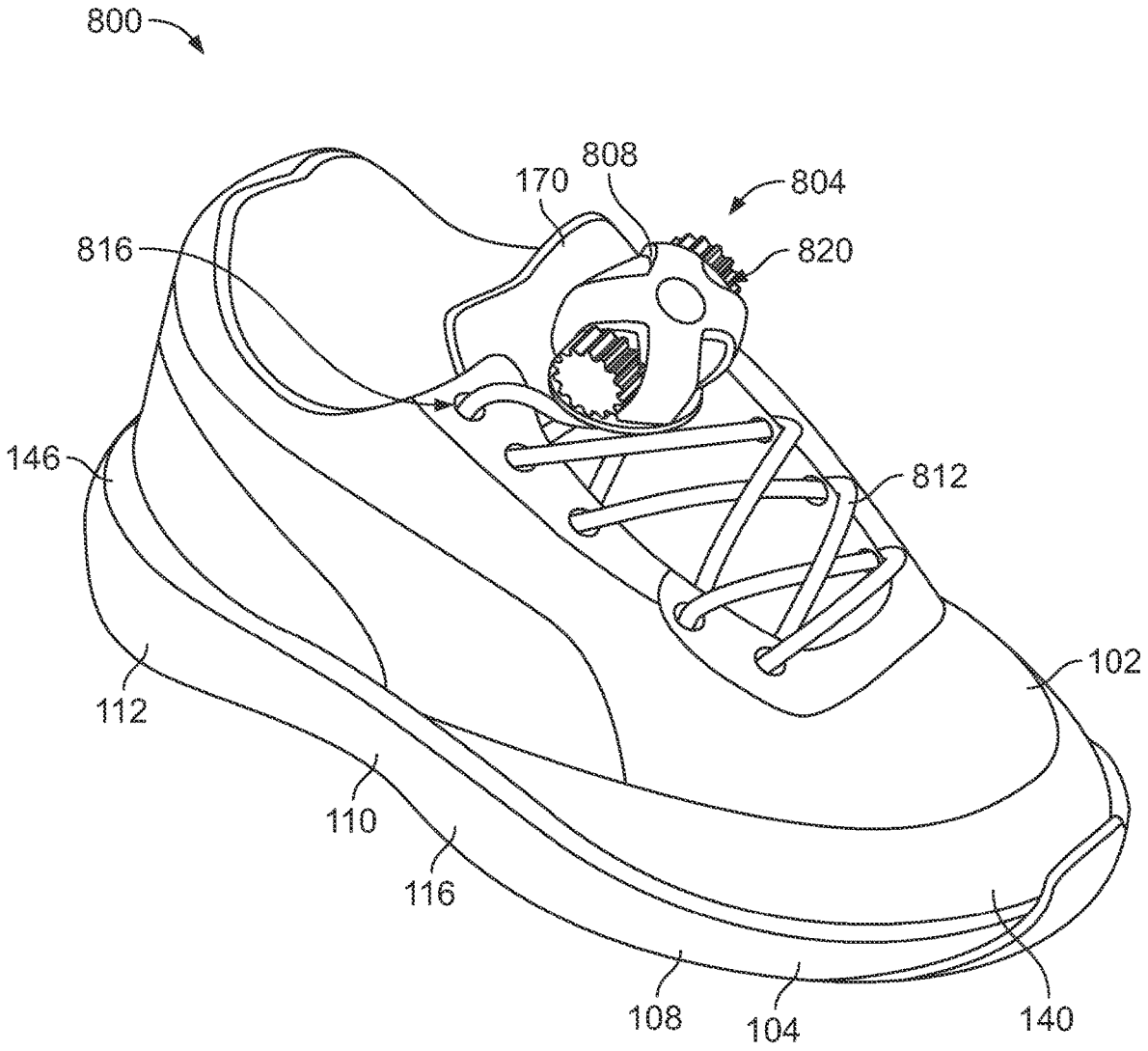
FIG. 15 is a schematic representation of a perspective view of a lateral side of an article of footwear configured as a right shoe having a closure system.

FIG. 15 depicts a schematic representation of another embodiment of an article of footwear 800 having a closure system 804 that includes a closure mechanism 808 and a lace 812 that is operably coupled to the upper 102 and the closure mechanism 808 to tighten and/or loosen the footwear 800. In this embodiment, elements that are shared with—i.e., that are structurally and/or functionally identical or similar to—elements present in the previous embodiments (See FIGS. 9-14) are represented by like reference numerals. The lace 812 is operably engaged with a plurality of eyelets 816 to define a winding region 820 of the upper 102. In particular, the closure mechanism 808 is configured to be removably mounted to the upper 102 for adjusting the footwear 800 between tightened and loosened configurations. The lace 812 is passed through the eyelets 816 disposed on the upper 102 in the winding region 820. The eyelets 816 may be provided as openings or holes in the upper alongside/adjacent the tongue 170, and the laces 812 may be passed therethrough. Additionally or alternatively, the eyelets 816 may be provided as loops, flaps, or hooks extending from the upper and disposed along or on the tongue 170 for engagement with the laces 812. As illustrated in FIG. 15, the closure mechanism 808 is located within the winding region 820 and entirely exposed externally of the footwear 800 while being secured against the tongue 170. In the illustrated embodiment, the closure mechanism 808 is configured to be removably mounted to the upper 102 for adjusting the footwear 800 between tightened and loosened configurations.

Figure 16:
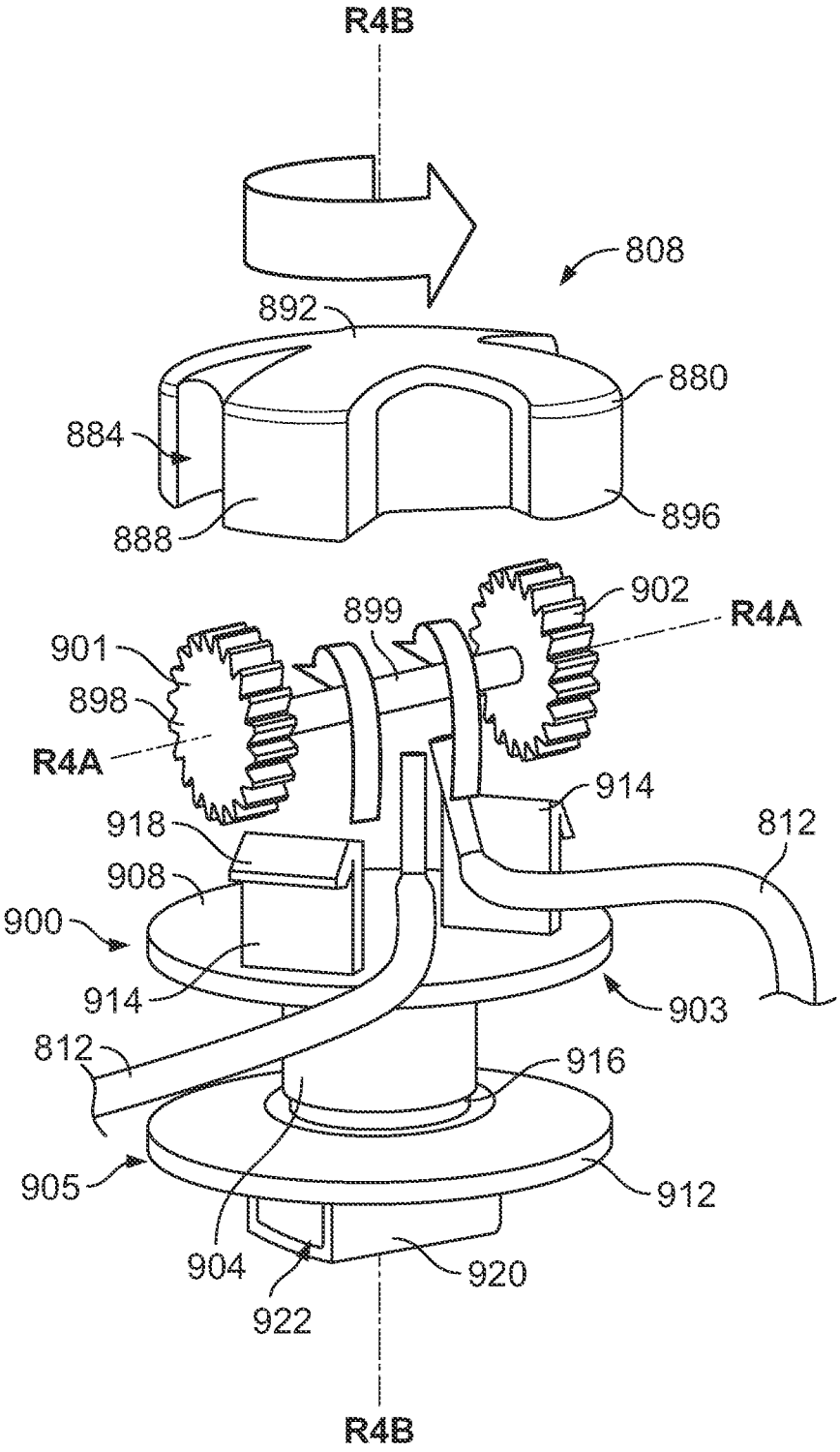
FIG. 16 is a schematic representation of an exploded view of the closure mechanism that is configured to be removably mounted to an upper.

FIG. 16 is a schematic representation of an exploded view of the closure mechanism 808 that is configured to be removably mounted to the upper 102. In the illustrated embodiment, a head cap 880 has indentations 884 diametrically opposed from one another and formed on an angled side wall 888 between a top end 892 and a lower end 896. The indentations 884 are provided to receive a rotating spool 898 which rotates about a first rotational axis R4A. To retain the lace 812 along the rod 899, a first disc-shaped flange 901 and a second disc-shaped flange 902 are disposed at the axial ends of the rod 899. Further, the rotating spool 898 may include similar components (e.g., channels 730) as the spool 700 illustrated in FIG. 11. The laces 812 are configured to be wound about the rod 899 that is rotated around and intersected by the first rotational axis R4A.

Figure 17:
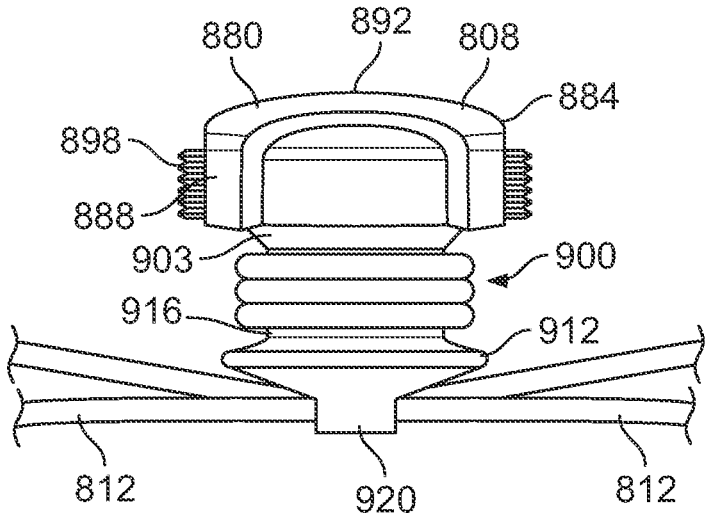
FIG. 17 is a side view of a closure system.

In addition, the head cap 880 is attached to a collector spool 900 that defines a second rotational axis R4B of the closure mechanism 808. In the illustrated embodiment, the collector spool 900 includes an upper portion 903 and a shaft 904 connecting the upper portion 903 to a lower portion 905. In some embodiments, the rod 899 defines the first rotational axis R4A and the shaft 904 defines the second rotational axis R4B, and the first and second rotational axes R4A, R4B are disposed perpendicular to each other. The upper portion 903 includes an upper flange 908 and the lower portion 905 includes a lower flange 912. The upper flange 908 may include a plurality of protrusions 914 extending parallel to the rotational axis R4B. In the illustrated embodiment, each protrusion of the plurality of protrusions 914 includes a beveled tip 918 for engagement with the head cap 880. The plurality of protrusions 914 are arranged diametrically opposed from one another and formed to match the shape of the indentations 884 and the angled side walls 888 of the head cap 880. The head cap 880 may be removably attached, e.g., snap-fit, to the collector spool 900 by engaging the plurality of protrusions 914. In the illustrated embodiment of FIG. 17, the head cap 880 is joined with the collector spool 900 by engaging the plurality of protrusions 914 and the rotating spool 898 is disposed therebetween. The rotating spool 898 may include apertures (not shown) or fastening mechanisms (not shown) disposed along the rod 899. Because the lace 812 is attached to the rod 899, the lace 812 is wound around the rod 899 when the rotating spool 898 is rotated to tighten or loosen the lace 812. As the rotating spool 898 is rotated about the first rotational axis R4A, a portion of the lace 812 is wound around, i.e., collected by, the collector spool 900.

In some embodiments, a pivot joint 916 is carried by the lower flange 912 of the lower portion 905 and extends coaxially relative to the rotational axis R4B. The upper and lower flanges 908, 912 are cylindrical, although other shapes are contemplated. In some embodiments, the upper portion 903 and the lower portion 905 are configured to be rotated relative to one another about the pivot joint 916 and the second rotational axis R4B. As a result of this rotation, the lace 812 can be wound around the shaft 904 of the collector spool 900. Accordingly, additional lengths of lace 812 may be wound about the rotating spool 898, which may be used to adjust the tension of the lace 812 and to secure the rotating spool 898 in accordance with the desired tension. Referring to FIG. 16, the lower flange 912 includes a securing element 920 extending therefrom as U-shaped member and a channel 922 is defined between the securing element 920 and the lower flange 912. In operation, the laces 812 are threaded through the channel 922 of the securing element 920 transversely relatively to the second rotational axis R4B to securely mount the collector spool 900 to the article of footwear 800. In some embodiments, the laces 812 are wrapped around an exterior of the securing element 920 to securely mount the collector spool 900 to the article of footwear 800. The rotating spool 898 is configured to be positioned atop the upper flange 908.

Figure 18:
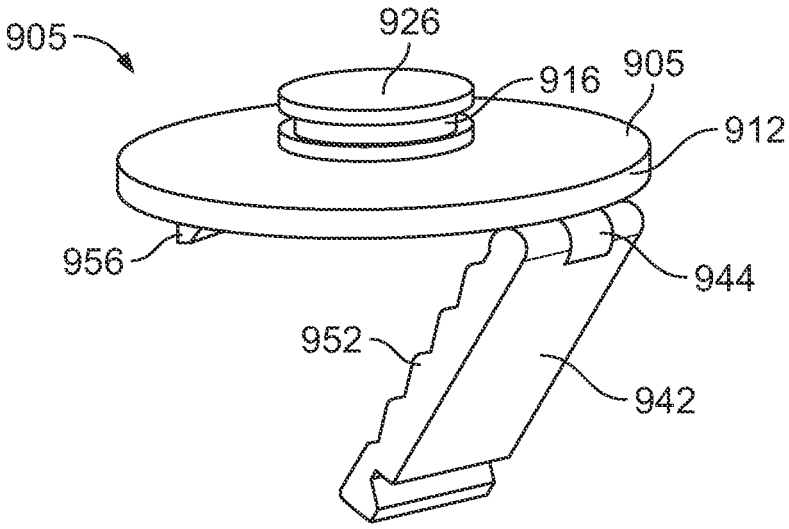
FIG. 18 is a perspective view of another embodiment of a lower portion of a closure system.

FIG. 18 illustrates the lower portion 905 of the collector spool 900. In the illustrated embodiment, the lower flange 912 is generally disc-shaped, although other shapes are contemplated. The pivot joint 916 is formed, in part, by a cylindrical stem or connector 926 extending away from the lower flange 912 of the lower portion 905. The connector 926 is configured to be attached to, e.g., snap-fit into, the shaft 904 of the upper portion 903 (see FIG. 18) of the closure mechanism 808, such that the upper portion 903 is capable of rotating relative to the lower portion 905. The pivot joint 916 is disposed axially opposite of the upper flange 908 of the shaft 904. A rectangular panel 942 is coupled to the lower flange 912 at a hinge 944 to form a hinge mechanism for securing the collector spool 900 to the article of footwear 800 (se FIG. 15). The panel 942 has a plurality of rivets 952 that allow the lace 812 to be wrapped or wound around. In the illustrated embodiment, a locking mechanism 956 is provided to secure the panel 942 to the connector 926, although other configurations are contemplated.

Figure 19:
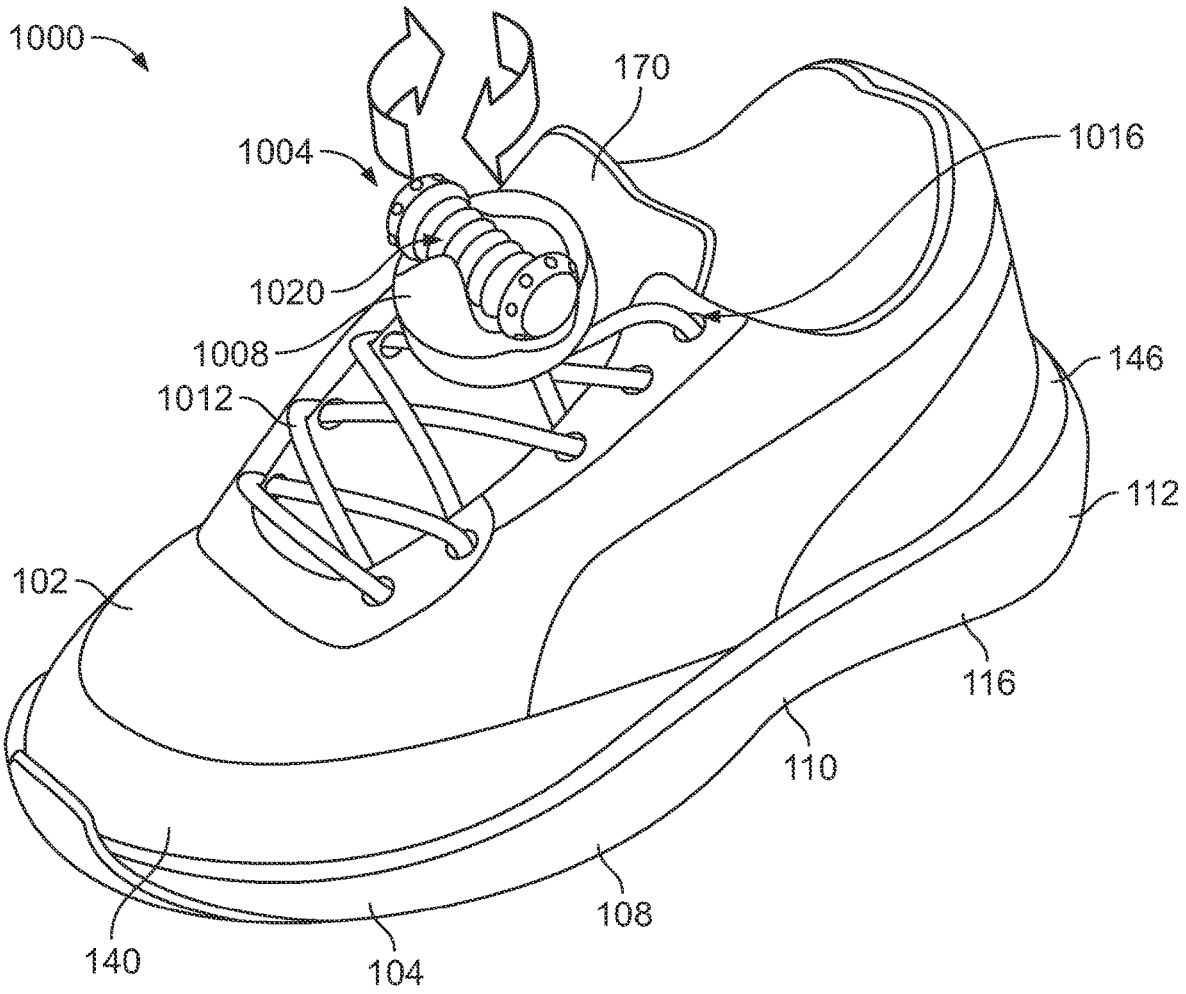
FIG. 19 is a schematic representation of a perspective view of a lateral side of an article of footwear having a closure system.

FIG. 19 depicts a schematic representation of another embodiment of an article of footwear 1000 having a closure system 1004 that includes a closure mechanism 1008 and a lace 1012 that is operably coupled to the upper 102 and the closure mechanism 1008 to tighten and/or loosen the footwear 200. The lace 1012 is operably engaged with a plurality of eyelets 1016 to define a winding region 1020 of the upper 102. In particular, the closure mechanism 1008 is configured to be removably mounted to the upper 102 for adjusting the footwear 1000 between tightened and loosened configurations. The lace 1012 is passed through the eyelets 1016 disposed on the upper 102 in the winding region 1020. The eyelets 1016 may be provided as openings or holes in the upper 102 alongside/adjacent the tongue 170, and the laces 1012 may be passed therethrough. Additionally, or alternatively, the eyelets 1016 may be provided as loops, flaps, or hooks extending from the upper 102 and disposed along or on the tongue 170 for engagement with the laces 1012. As illustrated in FIG. 19, the closure mechanism 1008 is located within the winding region 1020 and entirely exposed externally of the footwear 400 while being secured against the tongue 170. In the illustrated embodiment, the closure mechanism 1008 is configured to be removably mounted to the upper 102 for adjusting the footwear 1000 between tightened and loosened configurations.

Figure 20:
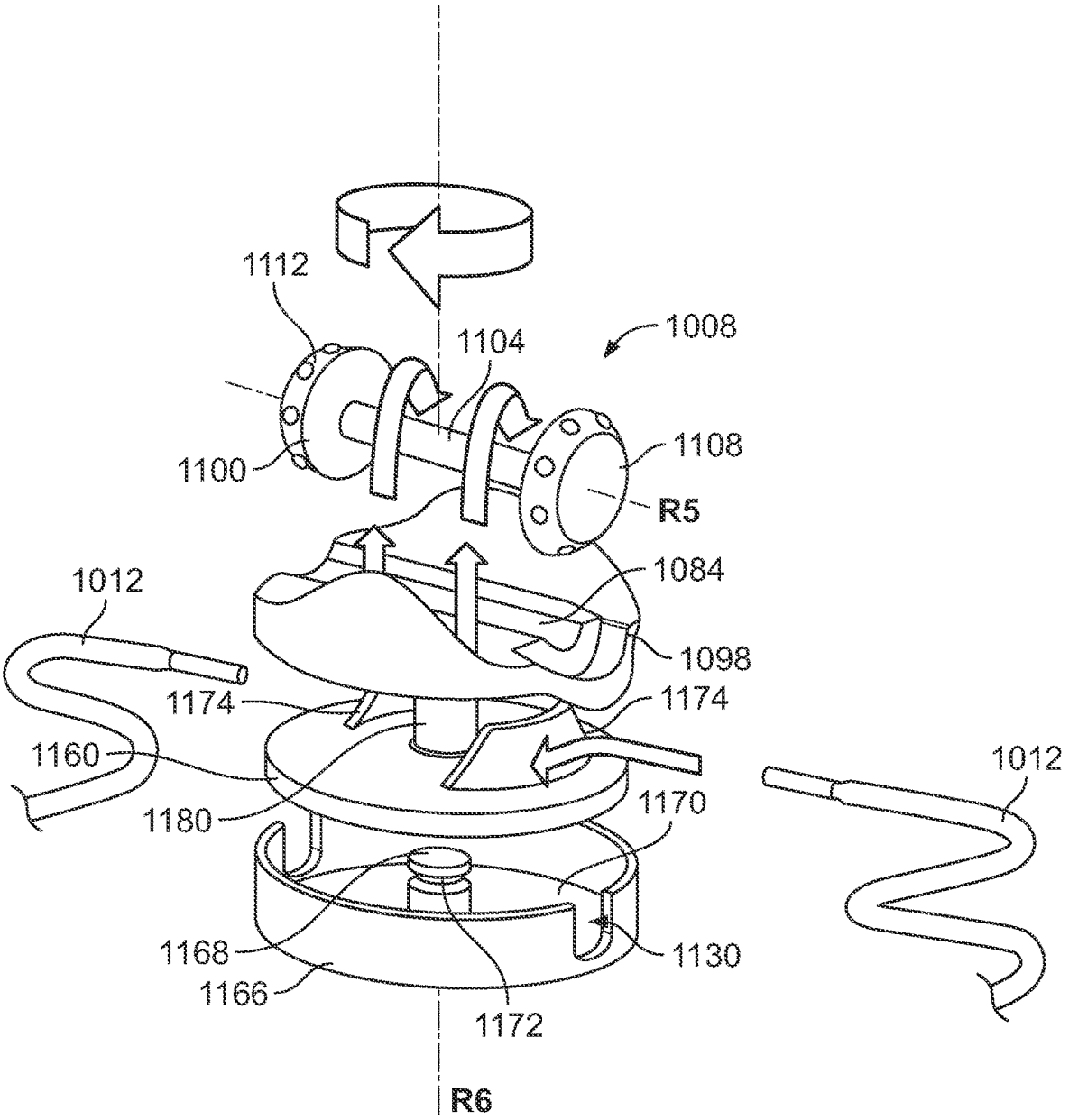
FIG. 20 is a schematic representation of an exploded view of the closure mechanism that is configured to be removably mounted to the upper.

FIG. 20 is a schematic representation of an exploded view of the closure mechanism 1008 that is configured to be removably mounted to the upper 102. The closure mechanism 1008 includes a spool base 1098 and a collector spool 1100. The collector spool 1100 is removably mounted to the spool base 1098. In the illustrated embodiment, the collector spool 1100 includes a shaft 1104 extending between first and second flanges 1108, 1112. The first and second flanges 1108, 1112 are connected by the shaft 1104 and configured to rotate about a first rotational axis R5 defined by an axial direction of the shaft 1104. In the illustrated embodiment, the first and second flanges 1108, 1112 are cylindrical, although other shapes are contemplated. The collector spool 1100 is configured to fit rotatably with the spool base 1098 such that the first and second flanges 1108, 1112 are frictionally engaged with the spool base 1098 in both axial and rotational directions to provide partially inhibited rotational. Further, the spool base 1098 has a groove 1084 that allows the lace 1012 to be wound about the collector spool 1100 when rotated about the taxis R5. The spool base 1098 may include apertures (not shown) to receive the lace 1012. The spool base 1098 is configured to be coupled to a locking mechanism 1160 provided in the form of a lace locking disc. In the illustrated embodiment, the lace locking disc 1160 is attached to the bottom housing 1166, although other configurations are possible. The bottom housing 1166 includes a center shaft 1168 extending from a bottom surface 1170 of the bottom housing 1166. The center shaft 1168 includes a groove 1172 that may be used to partially join the lace locking disc 1160 with the bottom housing 1166. The lace locking disc 1160 includes a protruding flange 1174 that extends from the bottom surface 1170 of the lace locking disc 1160 and extends partially in a radial direction about a center stem 1180. In some embodiments, the protruding flange 1174 may be configured to serve as a locking feature for selective engagement with the lace locking disc 1160. In operation, the laces 1012 are wound around the center stem 1180 that defines a vertical rotational axis R6 of the bottom housing 1166. The laces 1012 are inserted through the channels 1130 of the spool base 1098 and continue winding around the lace locking disc 1160. In some embodiments, the laces 1012 may be inserted through an aperture (not shown) within the collector spool 1100 and the lace 1012 is wrapped or wound around the collector spool 1100. The lace locking disc 1160 is configured to be rotated about a second rotational axis R6, which is perpendicular to the first rotational axis R5.

Figure 21:
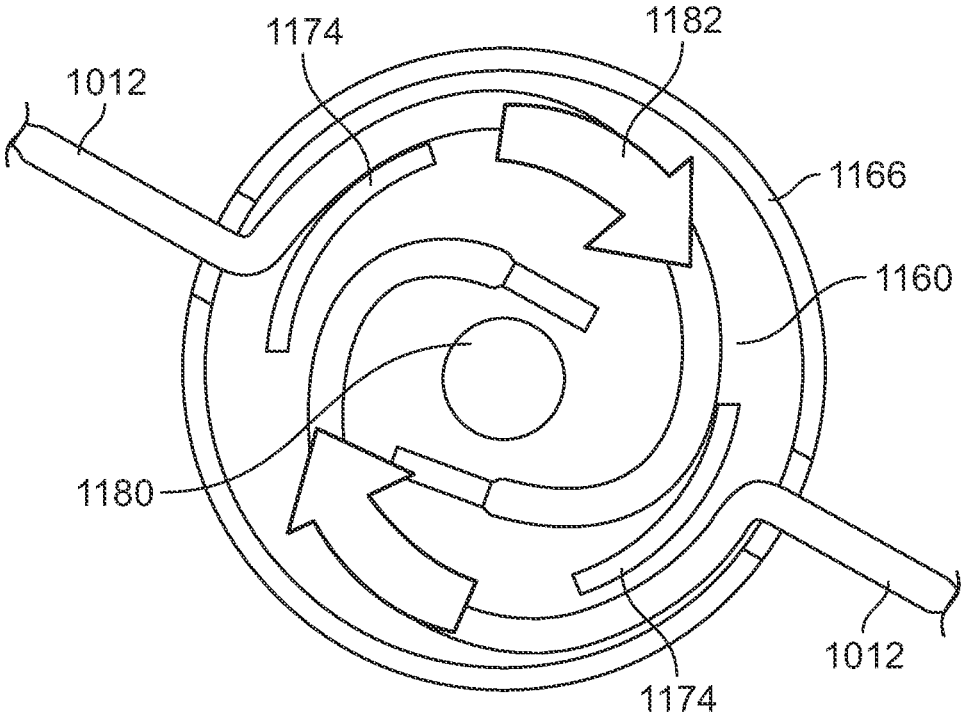
FIG. 21 is a top view of the bottom housing of a closure mechanism.

FIG. 21 is a top view of the lace locking disc 1160 and the bottom housing 1166. In use, the laces 1012 are wound around the center stem 1180 of the lace locking disc 1160 that is configured to sit within the bottom housing 1166. The protruding flange 1174 directs the laces 1012 to wind around the center stem 1180. In some embodiments, the lace 1012 may be wound by rotating the lace locking disc 1160 in a clockwise direction 1182 and may be unwound by rotating the lace locking disc 1160 in a counterclockwise direction.

Figure 22:
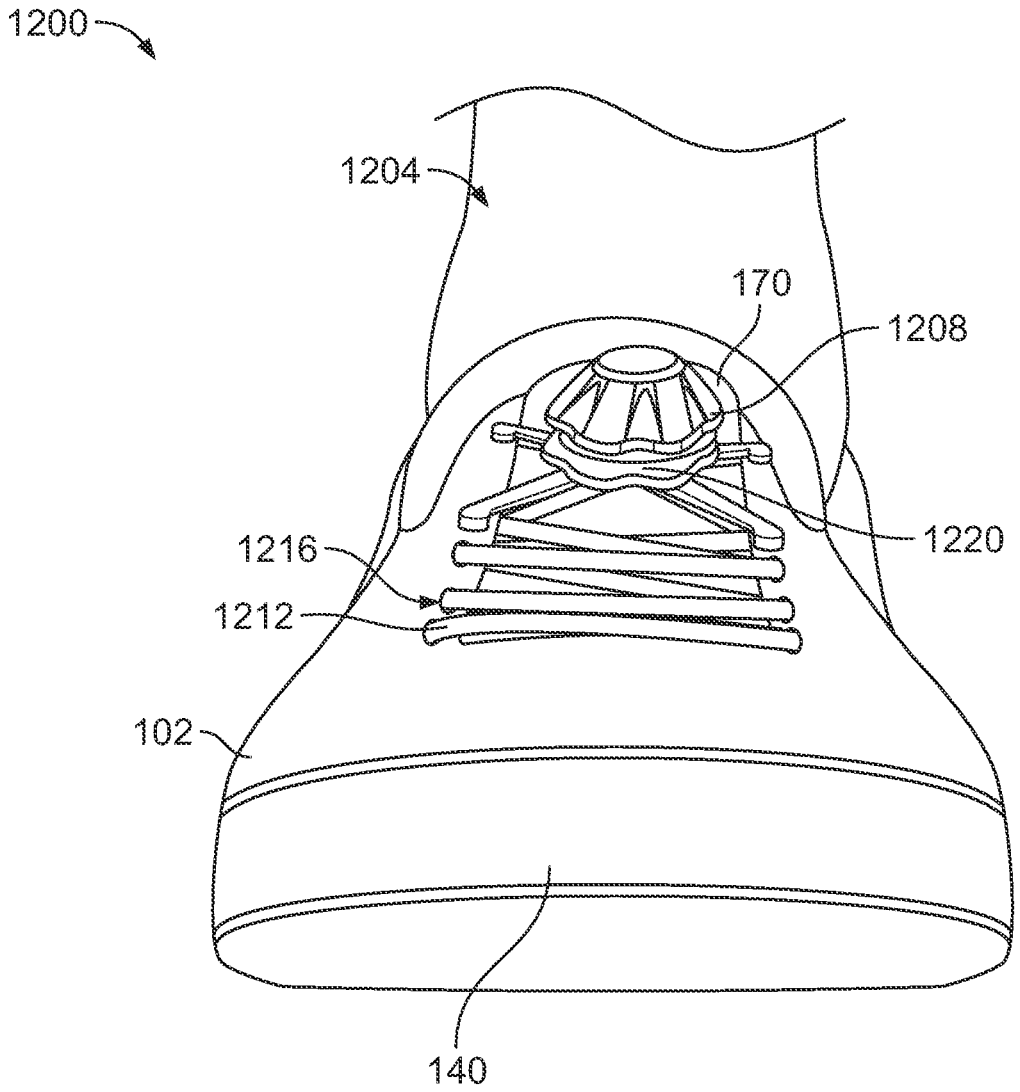
FIG. 22 is a front view of an article of footwear having a closure system.

FIG. 22 is another embodiment of an article of footwear 1200 having a closure system 1204 that includes a closure mechanism 1208 in the form of a lace collector spool 1210 and a lace 1212 that is operably coupled to the upper 102 and the closure mechanism 1208 to tighten and/or loosen the footwear 1200. In this embodiment, elements that are shared with—i.e., that are structurally and/or functionally identical or similar to—elements present in the first embodiment (article of footwear 100) are represented by like reference numerals. The lace 1212 is operably engaged with a plurality of eyelets 1216 to define a winding region 1220 of the upper 102. In particular, the closure mechanism 1208 is configured to be removably mounted to the upper 102 for adjusting the footwear 1200 between tightened and loosened configurations. The lace 1212 is passed through the eyelets 1216 disposed on the upper 102 in the winding region 1220. The eyelets 1216 may be provided as openings or holes in the upper 102 alongside/adjacent the tongue 170, and the laces 1212 may be passed therethrough. Additionally or alternatively, the eyelets 1216 may be provided as loops, flaps, or hooks extending from the upper 102 and disposed along or on the tongue 170 for engagement with the laces 1212. As illustrated in FIG. 22, the closure mechanism 1208 is located within the winding region 1220 and entirely exposed externally of the footwear 1200. In the illustrated embodiment, the closure mechanism 1208 is configured to be removably mounted to the upper 102 for adjusting the footwear 1200 between tightened and loosened configurations.

Figure 23:
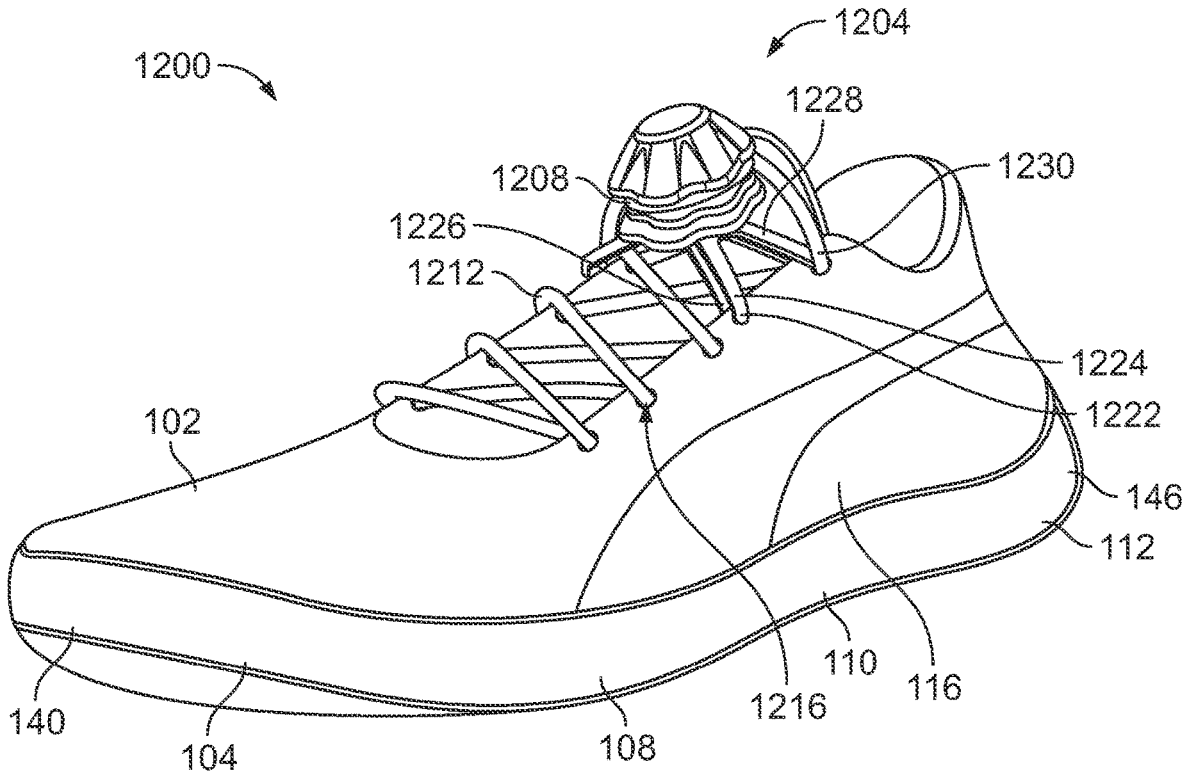
FIG. 23 is a schematic representation of a perspective view of a lateral side of an article of footwear having a closure system, according to another embodiment of the present disclosure.

FIG. 23 is a schematic representation of a perspective view of the lateral side 116 of an article of footwear 1200 having a closure system 1204. The laces 1212 are wrapped or wound around the closure mechanism 1208 and knotted or tied to secure the laces 1212. The closure mechanism 1208 is mounted onto a securing element 1222 comprising an upper portion 1224 and a lower portion 1226. The upper portion 1224 and the lower portion 1226 form a plurality of projections 1228. The upper portion 1224 of the plurality of projections 1228 may include a nub 1230 (see FIG. 26) and the lower portion 1226 of the plurality of projections 1228 may include a socket 1232 (see FIG. 26) to receive the nub 1230.

Figure 24:
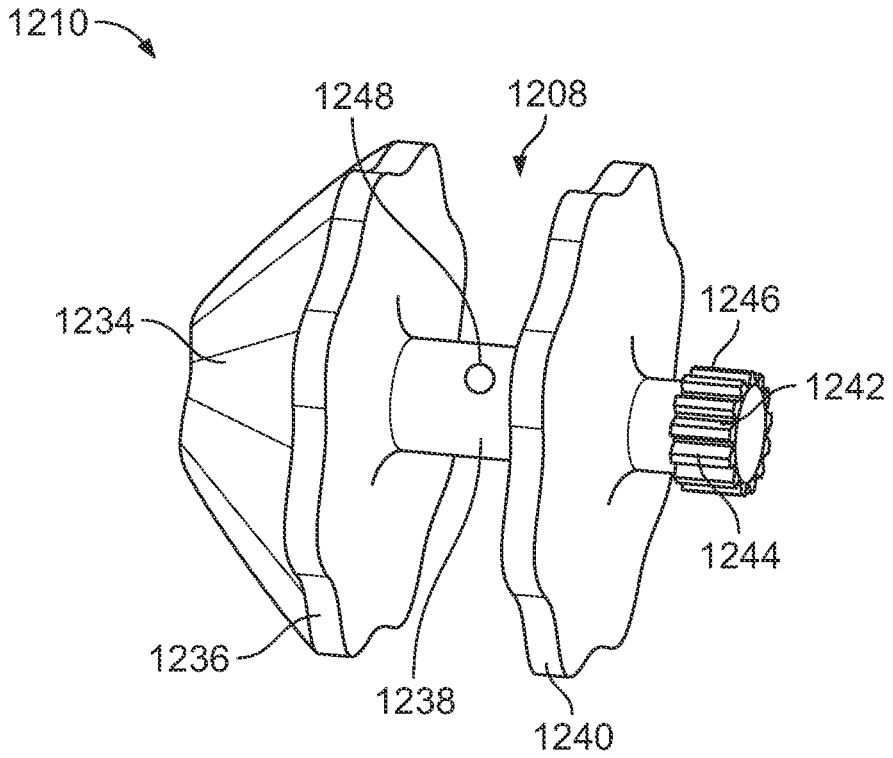
FIG. 24 is a perspective view of one embodiment of a closure mechanism.

FIG. 24 is a perspective view of the closure mechanism 1208. The closure mechanism 1208 includes the lace collector spool 1210 with a head cap 1234. In the illustrated embodiment, the head cap 1234 has a conical or semi-spherical shape and is secured to a top flange 1236. A shaft 1238 extends from the top flange 1236 opposite the head cap 1234 and axially to a bottom flange 1240, such that the shaft 1238 connects the top flange 1236 and the bottom flange 1240. In some embodiments, the top flange 1236, the shaft 1238, and the bottom flange 1240 are integrally formed as a unitary component. The bottom flange 1240 is attached to a projection 1242 which couples to a securing element 1222 (see FIG. 23). The projection 1242 may include a plurality of ridges 1244 disposed radially about a side wall 1246 of the projection 1242. In some embodiments, the shaft 1238 may include an aperture 1248 which receives the lace 1212.

Figure 25:
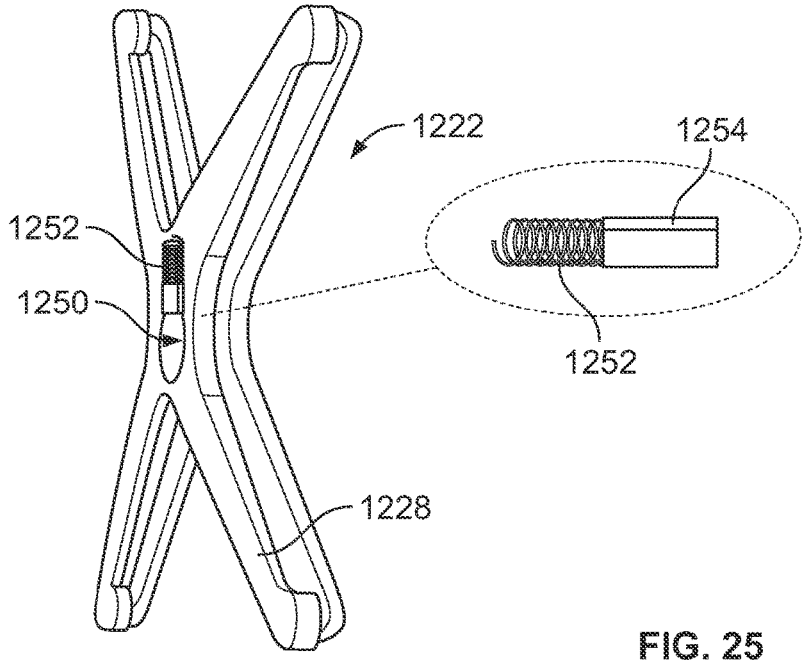
FIG. 25 is a perspective view of one embodiment of a securing element.

FIG. 25 is a perspective view of the securing element 1222. The securing element 1222 includes the plurality of projections 1228 that are configured to engage the upper 102 of the article footwear 1200 (see FIG. 23). The securing element 1222 further includes a central hole 1250 and a spring 1252 operative connected to a plunger 1254. The plunger 1254 is configured to be biased into an extended position, such that the plunger 1254 is disposed within the central hole 1250. In operation, the plunger 1254 is moved toward a retracted position to become displaced from the central hole 1250 and, thus, the spring 1252 becomes compressed with enough force to overcome the bias of the spring 1252. The projection 1242 (see FIG. 24) is inserted into the central hole 1250 of the securing element 1222 and the plurality of ridges 1244 is partially engaged with the plunger 1254. The projection 1242 may be configured to be removably attached to the securing element 1222 and may be removed as shown in FIG. 24.

Figure 26:
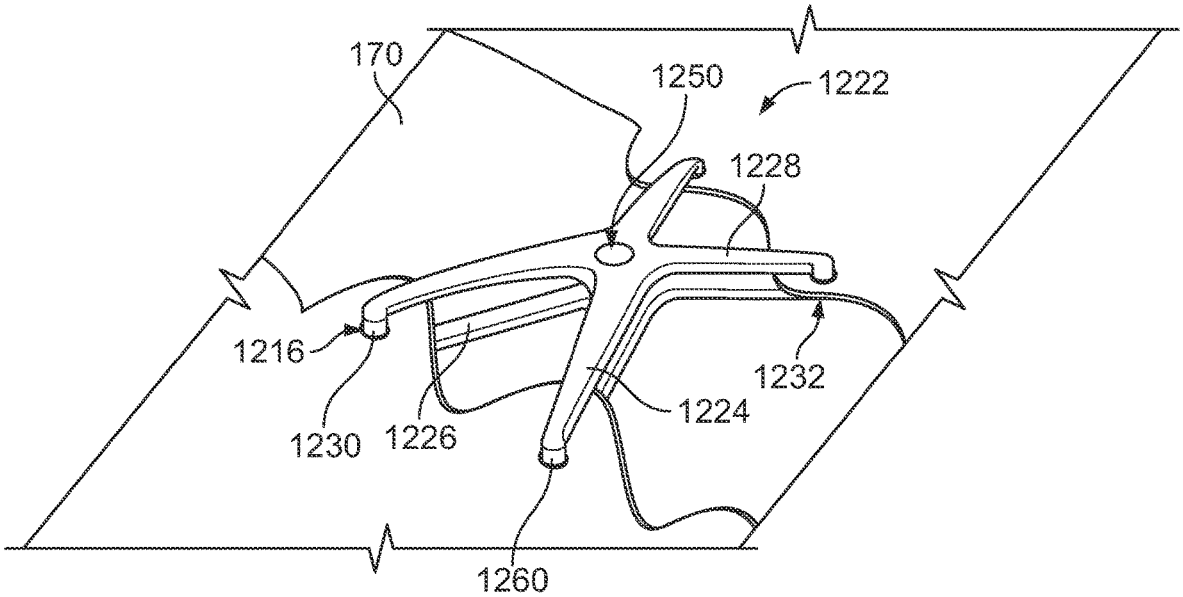
FIG. 26 is a perspective view of a securing element attached to a upper.

FIG. 26 is a perspective view of the securing element 1222 that is generally X-shaped and attached to the upper 102 and partially above the tongue 170 of the article of footwear 1200 (see FIG. 23). In some embodiments, the projections 1228 have the nubs 1230 at distal ends 1260 thereof, which are configured to be inserted through eyelets 1216 and mated with opposing distal ends 1260 of the projections 1228 that carry the sockets 1232 that are configured to receive the nubs 1230, e.g., via a snap-fit. The securing element 1222 includes the central hole 1250 disposed at the center of the upper portion 1224 of the securing element 1222. In some embodiments, the central hole 1250 may extend through both the upper portion 1224 and the lower portion 1226 of the securing element 1222.

Figure 27:
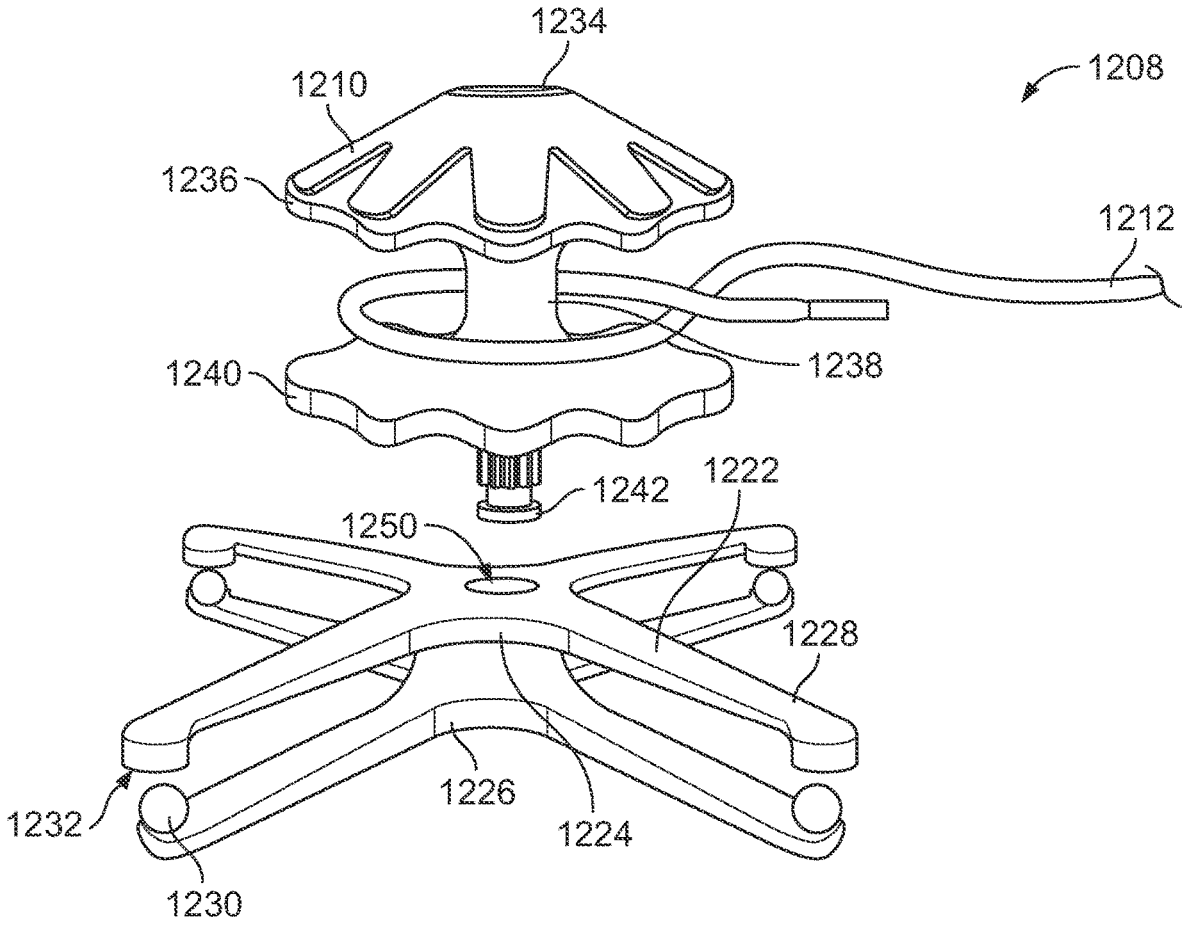
FIG. 27 is an exploded view of a closure system.

FIG. 27 is an exploded view of the closure system 1204 that includes the closure mechanism 1208 and securing element 1222. In the present disclosure, the upper portion 1224 of the securing element 1222 includes the socket 1232 and the lower portion 1226 of the securing element 1222 includes the nub 1230. In operation, the lace 1212 wraps or winds around the shaft 1238 of the lace collector spool 1210. As illustrated in FIG. 24, the shaft 1238 may include the aperture 1248 that partially receives the lace 1212. The projection 1242 of the closure mechanism 1208 is configured to be connected to the central hole 1250 of the securing element 1222.

Figure 28:
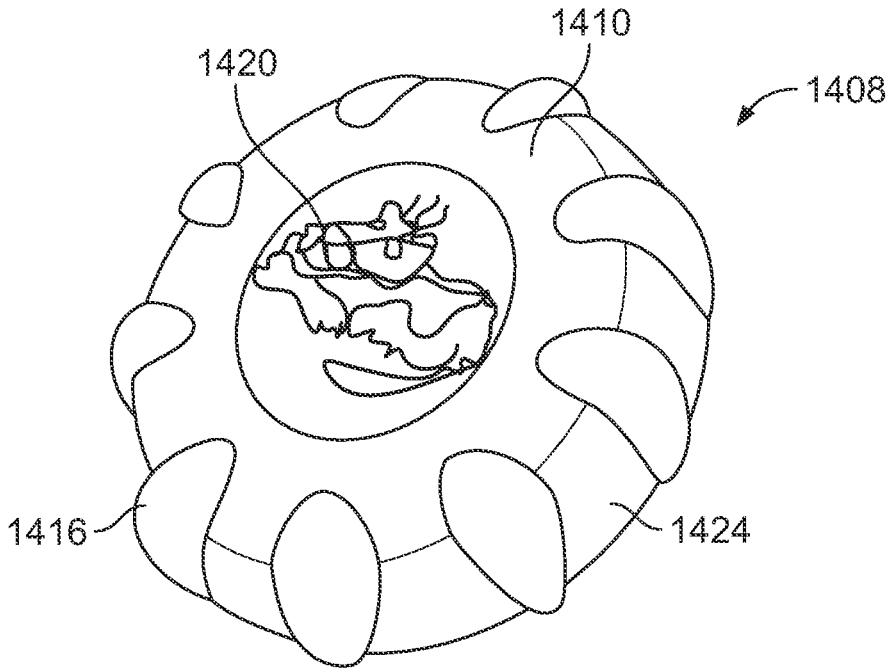
FIG. 28 is a perspective view of an alternate embodiment of a head cap of a closure mechanism.

FIG. 28 is a perspective view of an alternate embodiment of a closure mechanism 1408 that includes a head cap 1410, which is functionally similar to the head cap 1234 of FIG. 24. The head cap 1410 has a plurality of projections 1416 and indicia 1420 on an outer surface 1424 thereof.

Figure 29:
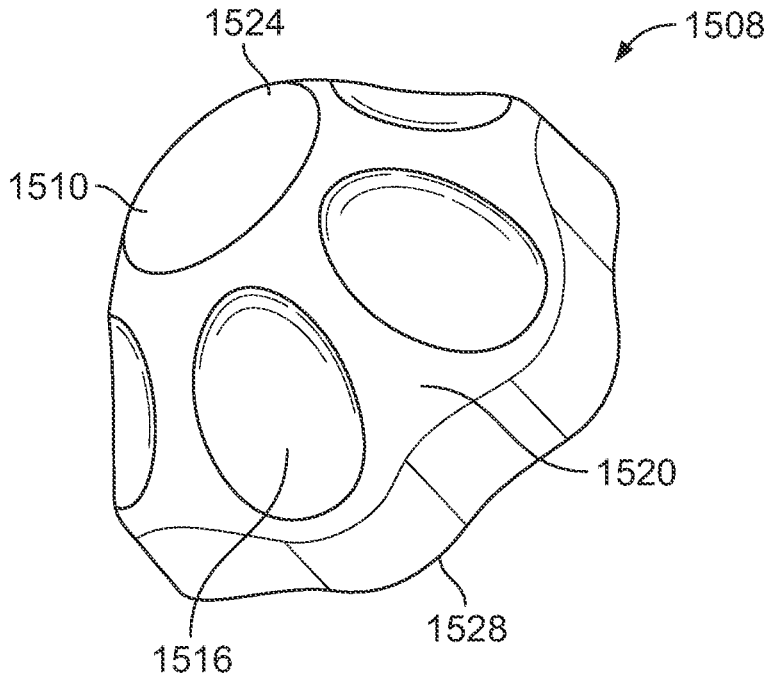
FIG. 29 is a perspective view of another embodiment of a head cap of a closure mechanism.

FIG. 29 is perspective view of another embodiment of a closure mechanism 1508 that includes a head cap 1510. The head cap 1510 of the closure mechanism 1508 may be provided as a conical- or frustoconical-shaped member, although other configurations are possible. The head cap 1510 further includes a plurality of indents 1516, an angled side wall 1520 disposed between a top end 1524 and a bottom end 1528 of the head cap 1510.

Figure 30:
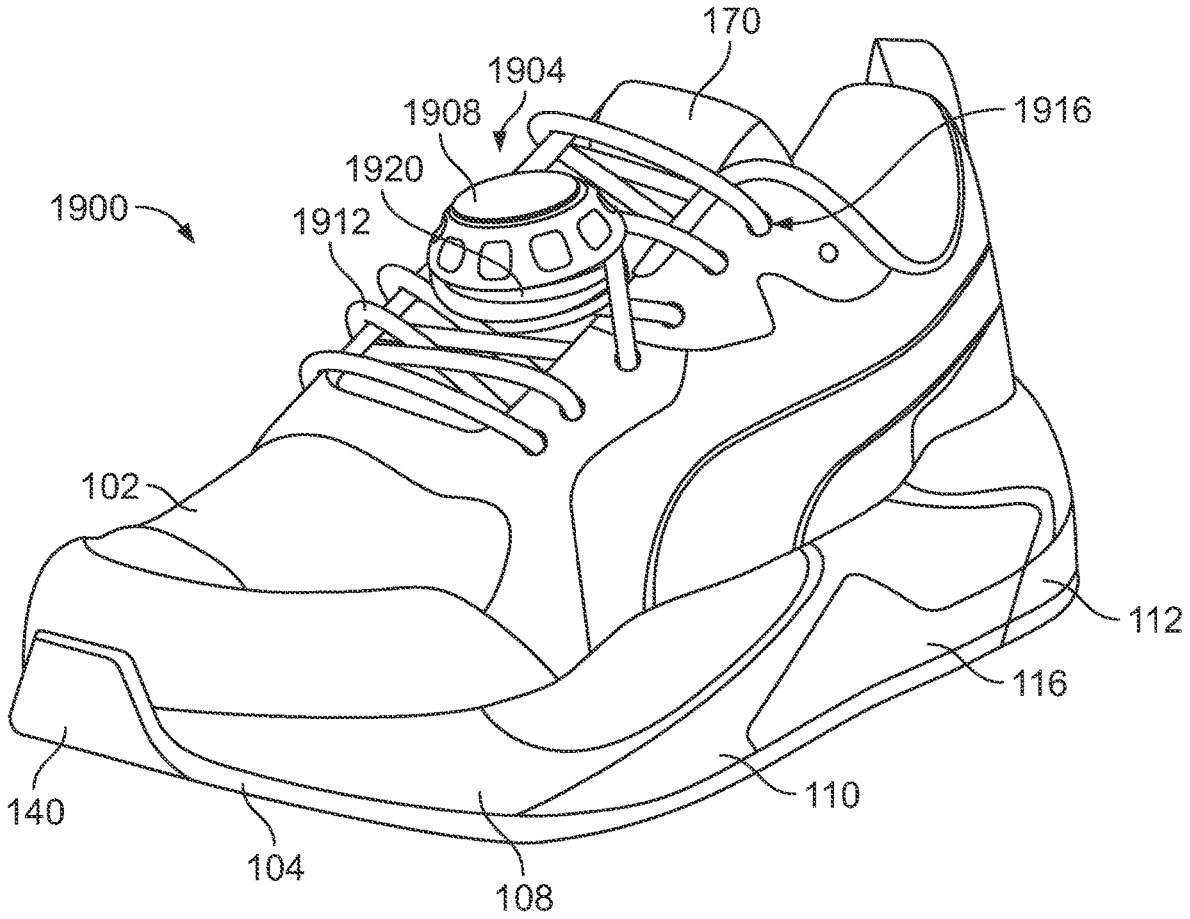
FIG. 30 is a schematic representation of a perspective view of a lateral side of an article of footwear having a closure system.

FIG. 30 is a perspective view of the lateral side 116 of an article of footwear 1900 having a closure system 1904 that includes a closure mechanism 1908 and a lace 1912 that is operably coupled to the upper 102 and the closure mechanism 1908 to tighten and/or loosen the footwear 1900. In this embodiment, elements that are shared with—i.e., that are structurally and/or functionally identical or similar to—elements present in the first embodiment (article of footwear 100) are represented by like reference numerals. The lace 1912 is operably engaged with a plurality of eyelets 1916 to define a winding region 1920 of the upper 102. In particular, the closure mechanism 1908 is configured to be removably mounted to the upper 102 for adjusting the footwear 1900 between tightened and loosened configurations. The lace 1912 is passed through the eyelets 1916 disposed on the upper 102 in a winding region 1920. The eyelets 1916 may be defined as openings or holes in the upper 102 alongside/adjacent the tongue 170, and the laces 1912 may be passed therethrough, while alternatively the eyelets 1916 may be provided as loops, flaps, or hooks extending from the upper 102 and disposed along or on the tongue 170 for engagement with the laces 1912. The closure mechanism 1908 is located within the winding region 1920 and entirely exposed externally of the footwear 1900. In the illustrated embodiment, the closure mechanism 1908 is configured to be removably mounted to the upper 102 for adjusting the footwear 1900 between tightened and loosened configurations.

Figure 31:
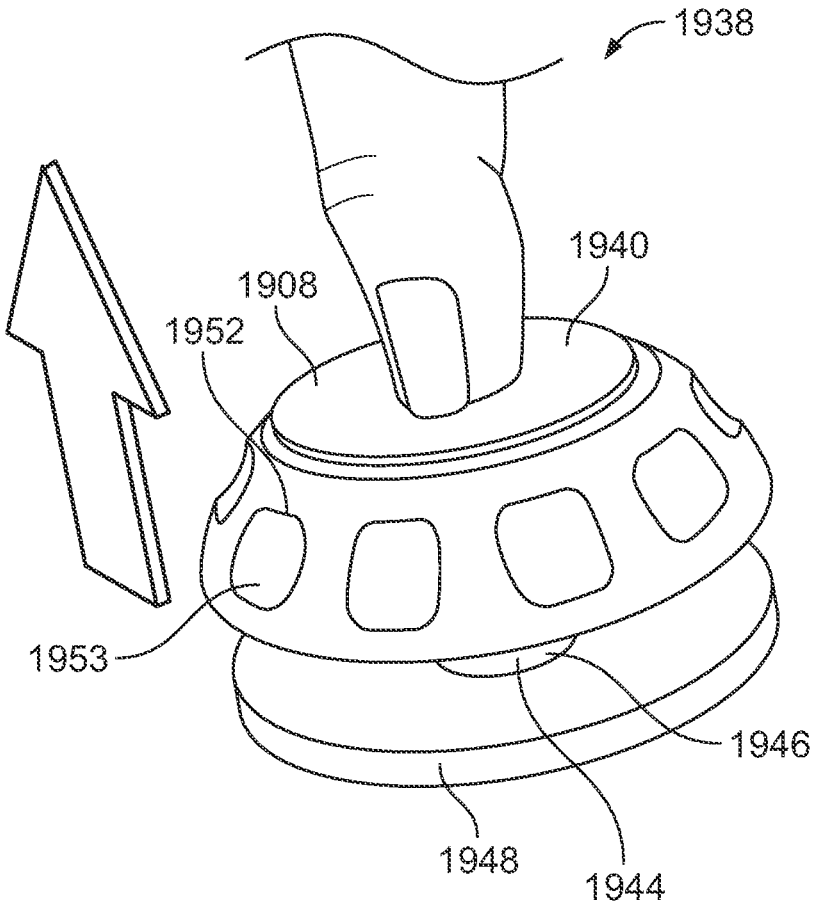
FIG. 31 is a perspective view of a closure mechanism in a first position.

FIG. 31 is a perspective view of the closure mechanism 1908 in a first position 1938. The closure mechanism 1908 includes a center button 1940. The spool 1944 includes a shaft 1946 that extends from the center button 1940 to a base 1948. The base 1948 may be a disc-shaped member or flange, but may be provided in other shapes. In operation, the center button 1940 is depressed while a user lifts or pulls a head cap or collar 1952 away from the center button 1940. The collar 1952 may include indentations 1953 disposed radially around the collar 1952, which ergonomically improve a user's grip of the collar 1952. In some embodiments, the center button 1940 is spring-loaded and can be latched and unlatched by consecutively depressing the center button 1940.

Figure 32:
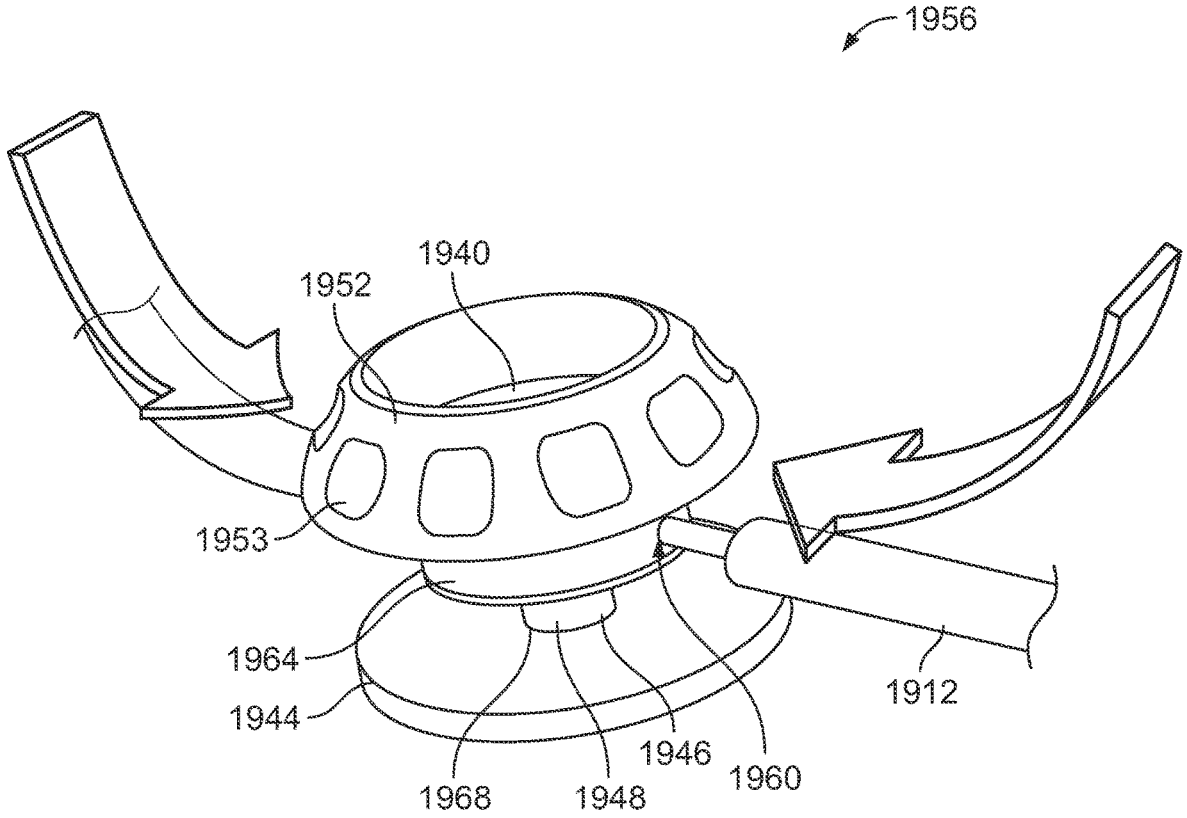
FIG. 32 is a perspective view of a closure mechanism in a second position.

FIG. 32 is a perspective view of the closure mechanism 1908 in a second position 1956. In operation, the laces 1912 are fed into holes 1960 that are positioned adjacent to an upper flange 1964 positioned opposite of the base 1948. The upper flange 1964 may be integrally formed with the center button 1940. The shaft 1946 is positioned between the upper flange 1964 and the base 1948 of the spool 1944. Similar to the mechanism illustrated in FIG. 16, the upper flange 1964 may be formed integrally with the shaft 1946 and a pivot joint (not shown) may be formed at a lower end 1968 of the shaft 1946. The pivot joint (not shown) is configured to create a rotational joint between the base 1948 and the upper flange 1964 of the spool 1944 to wind the laces 1912.

Figure 33:
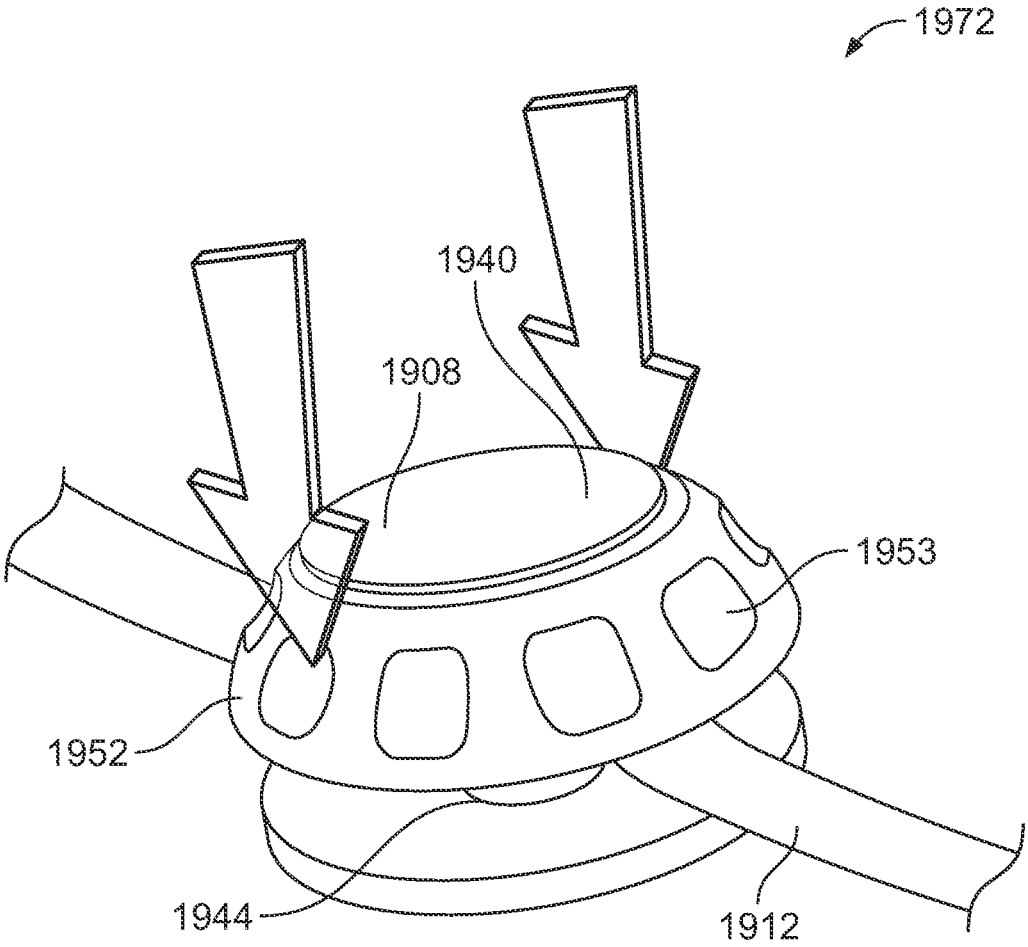
FIG. 33 is a perspective view of a closure mechanism in a third position.

FIG. 33 is a perspective view of the closure mechanism 1908 in a third position 1972. In use, the collar 1952 is pressed back down onto the closure mechanism 1908. In the present disclosure, the collar 1952 may be snapped onto the upper flange 1964 (see FIG. 32) of the spool 1944 to secure the laces 1912 within the holes 1960 disposed adjacent to the upper flange 1964 of the closure mechanism 1908.

Figure 34:
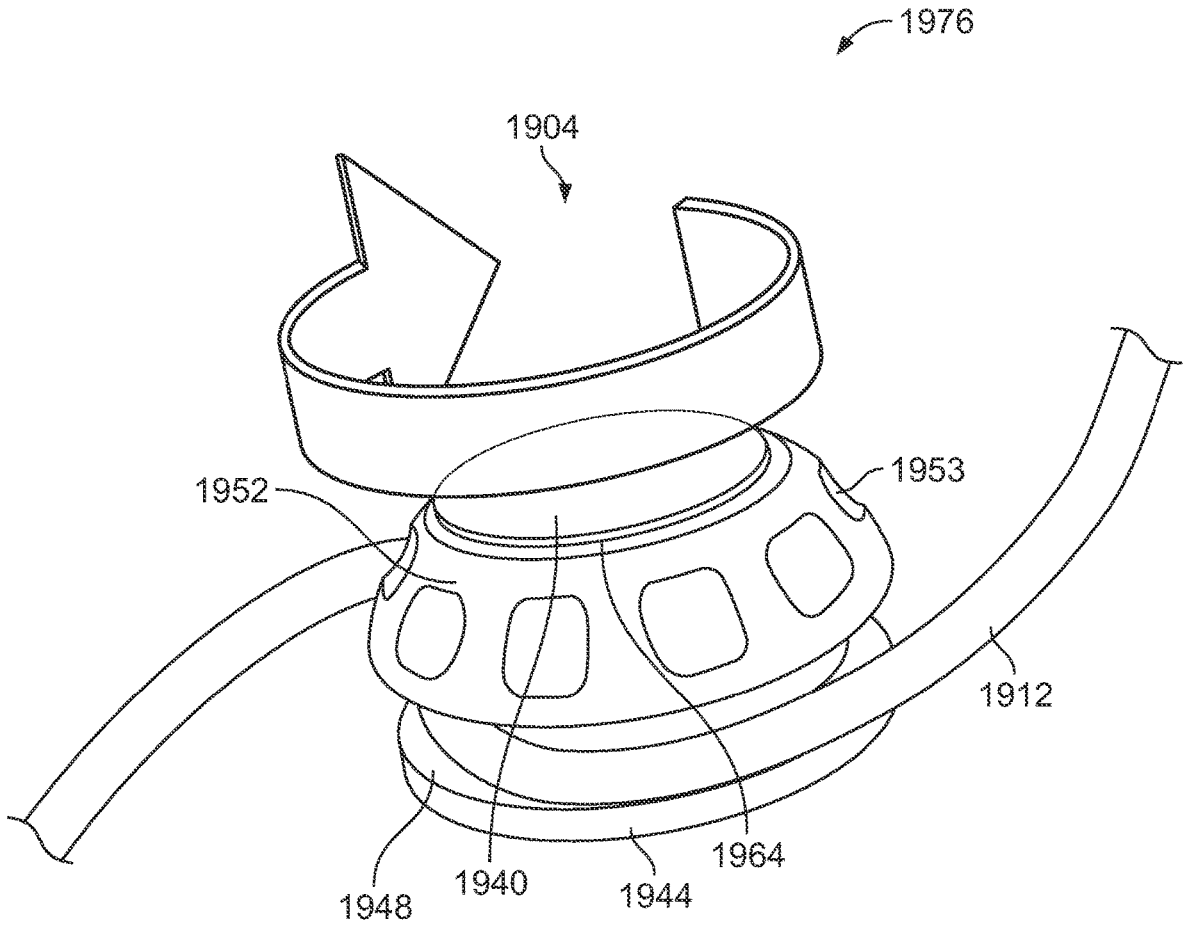
FIG. 34 is a perspective view of a closure mechanism in a fourth position.

FIG. 34 is a perspective view of the closure mechanism 1908 in a fourth position 1976. In use, the laces 1912 are wound around the shaft 1946 of the spool 1944 and secured threreon. In the present disclosure, the upper flange 1964 of the spool 1944 is rotated in a clockwise direction to tighten the laces 1912 of the footwear 1900 and is rotated in a counterclockwise direction to loosen the laces 1912 of the footwear 1900.

Figure 35:
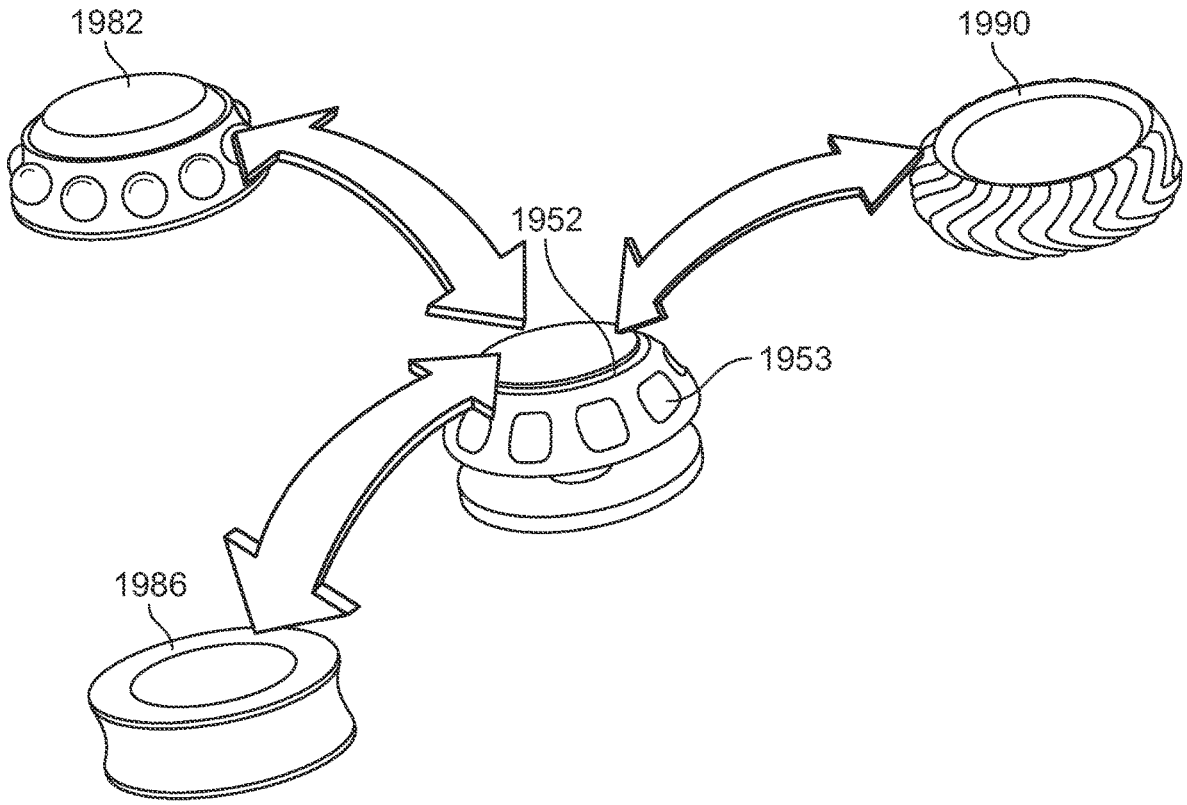
FIG. 35 is a perspective view of alternative embodiments of a head cap for a closure mechanism.

FIG. 35 is a perspective view comprising another embodiment of the collar 1952. The collar 1952 may be interchanged with collars 1982, 1986, 1990 of different colors, shapes and designs including with projections on the perimeter or with indentations on the perimeter.

Figure 36:
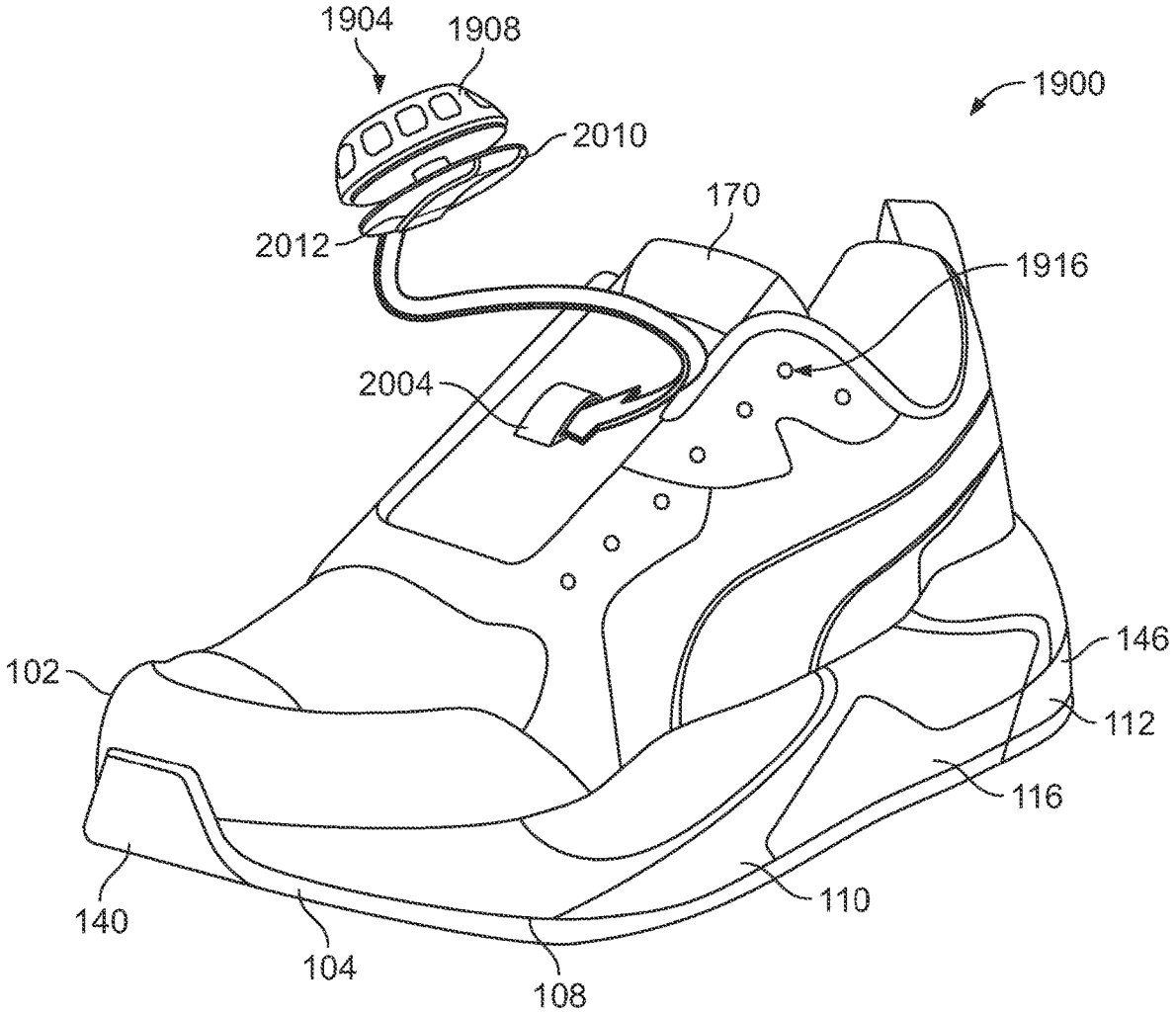
FIG. 36 is a perspective view of a lateral side of an article of footwear having a closure system operatively attached to the tongue of the upper.

FIG. 36 is a perspective view of the lateral side 116 of the article of footwear 1900 having the closure system 1904 operatively attached to the tongue 170 of the upper 102. The closure system 1904 includes a securing element 2010 that has a hook 2012 that attaches to a central loop 2004 of the tongue 170 of the upper 102. In some embodiments, the hook 2012 may be connected as a living hinge, a clip, or the like.

Figure 37:
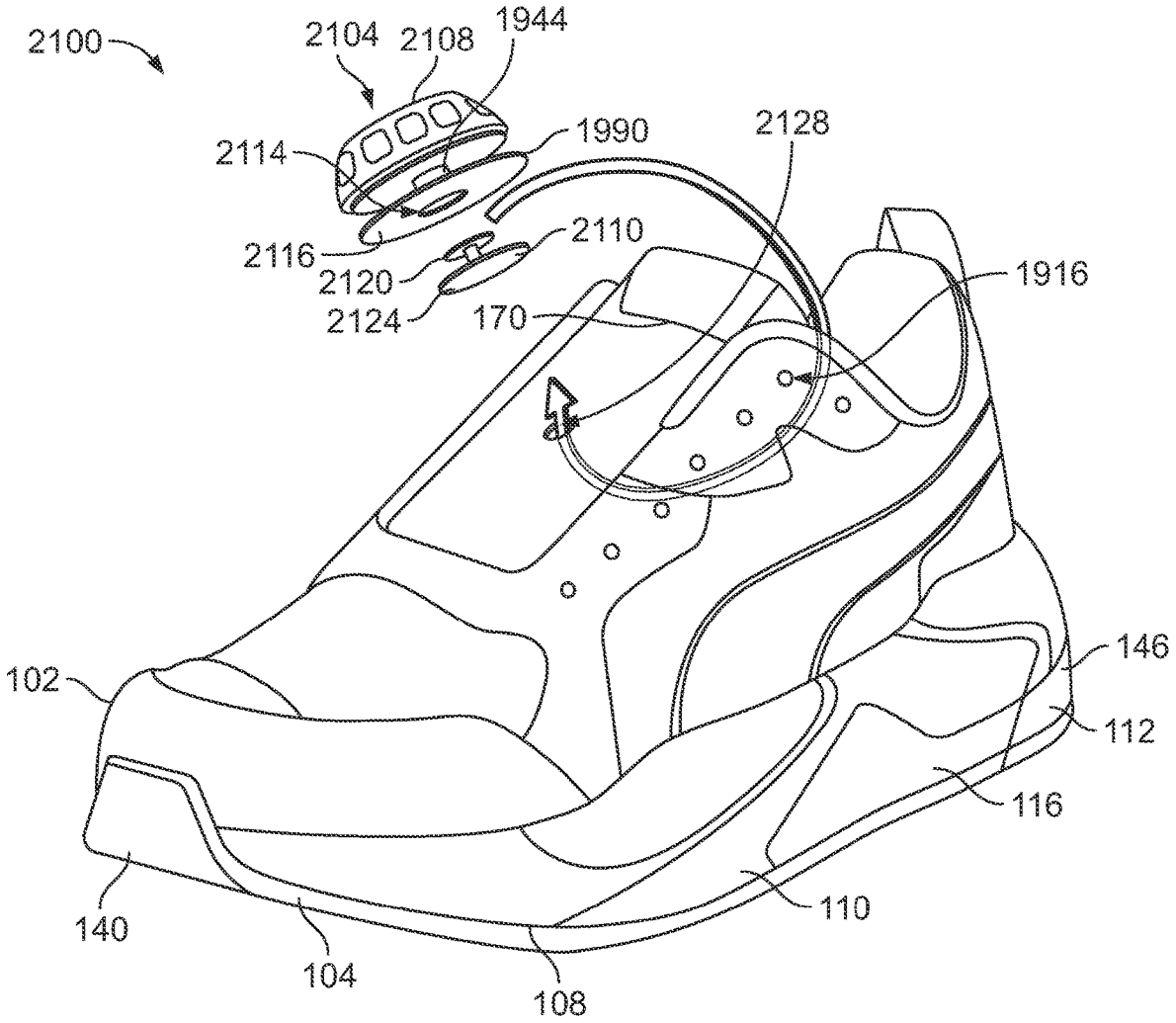
FIG. 37 is a perspective view of a lateral side of an article of footwear having an alternate closure system operatively attached to the tongue of the upper.

FIG. 37 is another embodiment of an article of footwear 2100 having a closure system 2104 comprising closure mechanism 2108 with a securing element 2110 provided in the form of a plug for mounting to the footwear 2100. The closure mechanism 2108 includes similar components as illustrated in the closure mechanism 1908 illustrated in FIGS. 30-34, such as the spool 1944. In operation, an aperture 2114 is positioned on a bottom surface 2116 of the closure mechanism 2108. A T-shaped protrusion 2120 extending from an inner base 2124 is fed through a hole 2128 in the tongue 170 and connects to the closure mechanism 2108. The aperture 2114 receives the T-shaped protrusion 2120 and attaches the closure mechanism 2108 to an article of footwear 2100.

Accordingly, the closure mechanism 208, 408, 608, 808, 1008, 1208, 1408, 1508, 1908, 2108 is configured to be used with various footwear by way of conventional laces. For example, the closure mechanism 208, 408, 608, 808, 1008, 1208, 1408, 1508, 1908, 2108 can be provided for use with different sizes or styles of footwear, especially footwear for children at ages when shoe size changes frequently. To that end, the closure mechanism 208, 408, 608, 808, 1008, 1208, 1408, 1508, 1908, 2108 is configured to be offered in a variety of colors. The head cap of the closure mechanism 208, 408, 608, 808, 1008, 1208, 1408, 1508, 1908, 2108 may be provided with lights (not shown), such as, e.g., LED lights, that are activated upon agitation or impact. In addition, the top end of the head caps or collars 1952, 1982, 1986, 1990 may be customized or individualized through the use of logos, lettering, symbols, numbering, or other indicia and markings. It is further contemplated that the securing element of the closure mechanism 208, 408, 608, 808, 1008, 1208, 1408, 1508, 1908, 2108 can be configured for removable attachment to the footwear 200, 400, 600, 800, 1000, 1200, 1900, 2100 without engagement with the lace, such as by engagement with the flap or the pull tab, among other configurations.

It is also contemplated that the closure mechanisms 208, 408, 608, 808, 1008, 1208, 1408, 1508, 1908, 2108 may be similar to those disclosed in U.S. Pat. Nos. 5,325,613, 5,600,875, 5,606,778, 5,638,588, 5,651,198, and 5,669,116, which are all commonly assigned to Puma SE and incorporated by reference in their entirety herein. For example, it is contemplated that the closure mechanisms 208, 408, 608, 808, 1008, 1208, 1408, 1508, 1908, 2108 may include one or more aspects of such closure mechanisms to provide tightening or loosening functionality when mounted on the respective footwear 200, 400, 600, 800, 1000, 1200, 1900, 2100 of the present disclosure.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications, and departures from the embodiments, examples, and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A closure system for an article of footwear, comprising:

a closure mechanism including a spool with at least one mounting tip protruding therefrom;

a securing element including a notch of a spool housing that is configured to receive the at least one mounting tip; and a lace that is configured to be operably engaged with an upper of the footwear, wherein the securing element is configured to be engaged with the footwear and the closure mechanism to removably secure the closure mechanism to the footwear, wherein the closure mechanism is configured to be rotated relative to the securing element to adjust the footwear between a loosened configuration and a tightened configuration, wherein the lace is configured to be engaged with the closure mechanism, wherein the spool includes a shaft and a first tab and a second tab positioned centrally on the shaft between a first disc and a second disc, wherein the first tab includes a first aperture extending therethrough and the second tab includes a second aperture extending therethrough, wherein the lace has a first end that is configured to pass through the first aperture and a second end that is configured to pass through the second aperture, and wherein the first disc and the second disc are configured to rotate with the housing.

2. The closure system of claim 1, wherein the lace is configured to be passed through a plurality of eyelets formed on the upper and through at least one channel formed on the spool.

3. The closure system of claim 1, wherein the securing element is configured to be engaged with a tongue of the footwear.

4. The closure system of claim 1, wherein the spool housing defines an interior volume and the spool is configured to be entirely contained within the interior volume.

5. A method of assembling a closure system for an article of footwear, comprising the steps of:

providing a closure mechanism comprising at least one spool that includes a shaft with a first tab positioned centrally on the shaft and including a first aperture that extends through the first tab, and a second tab positioned centrally on the shaft between a first disc and a second disc and including a second aperture that extends through the second tab;

providing a securing mechanism that is configured to removably secure the closure mechanism to the article of footwear; and coupling a lace to the shaft for engagement with the closure mechanism, wherein a first end and a second end of the lace are configured to pass through the apertures such that the first end is configured to pass through the first aperture and the second end is configured to pass through the second aperture, wherein the spool is rotated in a first direction to adjust the article of footwear to a tightened configuration, and wherein the spool is rotated in a second direction to adjust the article of footwear to a loosened configuration.

6. The method of claim 5, wherein the first direction is opposite of the second direction.

7. The method of claim 6, wherein the securing mechanism is disposed on an upper of the footwear.

* * * * *